US008517895B2

(12) United States Patent
Shalev et al.

(10) Patent No.: US 8,517,895 B2
(45) Date of Patent: Aug. 27, 2013

(54) VIBRATORY EXERCISE DEVICE

(76) Inventors: Pinchas Shalev, Herzeliya (IL); Ilan Greenberg, Haifa (IL)

( * ) Notice: Subject to any disclaimer, the term of this patent is extended or adjusted under 35 U.S.C. 154(b) by 0 days.

(21) Appl. No.: 13/388,059

(22) PCT Filed: Aug. 5, 2010

(86) PCT No.: PCT/IL2010/000635

§ 371 (c)(1),
(2), (4) Date: Jan. 31, 2012

(87) PCT Pub. No.: WO2011/016040

PCT Pub. Date: Feb. 10, 2011

(65) Prior Publication Data

US 2012/0129653 A1 May 24, 2012

Related U.S. Application Data

(60) Provisional application No. 61/231,326, filed on Aug. 5, 2009, provisional application No. 61/231,689, filed on Aug. 6, 2009, provisional application No. 61/236,097, filed on Aug. 23, 2009.

(51) Int. Cl.
*A63B 24/00* (2006.01)

(52) U.S. Cl.
USPC ..... 482/1; 482/92; 482/121

(58) Field of Classification Search
USPC ..... 482/1–9.92, 121–130, 148, 900–902; 601/70, 79
See application file for complete search history.

(56) References Cited

U.S. PATENT DOCUMENTS

| | | | |
|---|---|---|---|
| 5,730,687 | A | 3/1998 | Ledany |
| 5,823,913 | A | 10/1998 | Aruin et al. |
| 2003/0166434 | A1 | 9/2003 | Lopez-Santillana et al. |
| 2007/0259759 | A1 | 11/2007 | Summers et al. |
| 2007/0299374 | A1 | 12/2007 | Gesotti et al. |
| 2008/0139370 | A1 | 6/2008 | Charnitski |
| 2009/0053682 | A1 | 2/2009 | Stern |

*Primary Examiner* — Glenn Richman
(74) *Attorney, Agent, or Firm* — Soroker-Agmon

(57) ABSTRACT

An exercise device, including, at least one vibrational member that is adapted to vibrate at least a part of the trainee's body, a power interface adapted to enable powering the vibrational member, one or more attachments connected to the vibrational member, wherein said attachments include an elastic member or biasing member forming an aerobic exercise device that is adapted to resist the trainee's motion during an aerobic workout, or wherein said attachments include an aquatic member that is designed to provide buoyancy or resist motion through water forming an aquatic exercise device, or wherein said attachments are weights forming a barbell and the weights are made up from a plurality of small unit masses, each unit mass cushioned by a cushioning material.

25 Claims, 25 Drawing Sheets

VIBRATORY EXERCISE DEVICE

RELATED APPLICATIONS

This application claims priority from U.S. provisional application No. 61/231,326 filed on Aug. 5, 2009, U.S. provisional application No. 61/231,689 filed on Aug. 6, 2009, and U.S. provisional application No. 61/236,097 filed on Aug. 23, 2009 the disclosures of which are incorporated herein by reference.

FIELD OF THE INVENTION

The present invention relates generally to exercise equipment and more specifically to an apparatus that vibrates the user while performing exercise with the device.

BACKGROUND OF THE INVENTION

One common form of exercise includes aerobic exercise. Aerobic exercising is particularly helpful for weight control. Research consistently shows that regular physical activity, combined with healthy eating habits, is the most efficient and healthful way to control your weight.

The real benefits of aerobic exercise are achieved by increasing your heart rate and breathing hard for a period of time. During aerobic activity the body produces more energy and delivers more oxygen to the muscles. the heart beats faster and increases the blood flow to the muscles and then back to the lungs.

Aerobic means "with oxygen" and the body's aerobic system is the heart, lungs, blood vessels and muscles. The benefit of aerobic exercise is based on how well the body can deliver oxygen to the muscles and use it for energy. Regular aerobic workouts increase the ability to take in and transport oxygen and improve the body's aerobic capacity.

A good aerobic exercise program can help you live a longer, healthier life and enhance your well being. You get a multitude of benefits if you do your aerobic workout on a regular basis even if the intensity is low or short in duration.

Typically aerobic exercise is performed with equipment having an elastic element to enable repetitive motion, for example pulling and releasing an elastic band repetitively.

Adding vibrations or other stimulation sources (like EMS—Electrical Muscle Stimulation) to equipment used for aerobic physical exercise can increase the benefits of the workout. The body muscles react to the vibrations rather than increasing resistance to the motion being performed thus achieving training targets faster. Additionally, the vibrations increase the production of regenerative and repair hormones, improve blood circulation in skin and muscles, strengthen bone tissue, improve lymph drainage and increase the basal metabolic rate.

All this results in more strength, more speed, more stamina, rapid recovery of muscles and tissue, increased flexibility, mobility and coordination, anti-cellulitis, collagen improvement, and fat reduction.

The added value of the using vibrations and stimulation during training is to improve training quality and effectiveness, so the workout can be shortened and the trainee can recover faster. With the elderly and users with joint, back or other disorders, the vibration motion increases bone strength and helps build muscle, both of which help protect against the effects of osteoporosis. The massing effects greatly increase blood flow, and the repetitive stretching strengthens the joints and muscles of the trainee.

Another form of exercise includes aquatic exercise, wherein the exercise is performed in water using additional equipment that exploits the water to serve as an opposing force. Aquatic exercise has been found to be one of the best forms of exercise. The Water supports the trainee's body and alleviates most of the effects of gravity allowing the trainee to exercise specific muscle groups without stressing other areas of the body. The reduced physical strain on these other area allows the trainee to exercise for longer periods of time. The trainee is also able to exercise longer due to a lower and more stabilized body temperature resulting from contact with the water. Strain on the heart, muscles and ligaments are minimized while the benefits of physical activity are maximized.

Aquatic based physical therapy is most noticeably gaining popularity with the elderly, the obese, and the infirm, but still finds demand from people of all ranges of fitness and exercise regiment. There is a huge demand for an exercise modality which provides long-term health benefits and which can exist in the favorable environment of lower stress and freer movement.

The addition of a vibration source to equipment used for aquatic physical exercise increases the benefits of the workout. When training in aquatic conditions with equipment that vibrates in addition to acting against the water resistance, the trainee's body reacts independently to the vibrational acceleration rather than just to the resistance of the water.

When training with a vibrational source the trainee's body has to adapt even more to overcome the vibrations, thus achieving the training targets faster.

Another common form of exercise includes moving one's arm while grasping a weight. A barbell is a common form of weight for performing such exercise. A barbell includes an elongated member to be grasped by the user and weights attached on either end of the elongated member. Barbells are commonly used to train the arm muscles, for example the musculus bicep brachii and the musculus tricep brachii.

It has been found that exercising with a barbell that has an elongated member that vibrates increases the efficiency of training by transferring the vibrations to the muscles. Vibrational therapy of muscles is known to reduce the tendency to develop cramps, stimulate bone growth, increase production of endogenous cytokines, reduce joint pain and inflammation, increase bone fracture healing and can be used to treat osteoporosis.

U.S. Pat. No. 5,868,653 to Heinz Klasen the disclosure of which is incorporated herein by reference, describes a vibrating barbell that has a damping material interposed between the barbell bar and the weights attached to the ends of the barbell to prevent the weights from being subject to the vibrations. This increases the efficiency of the delivery of the vibrations to the muscles and reduces energy consumption of the motor producing the vibrations. The dampening material is provided as a wavy leaf spring having a ring shape that surrounds the barbell bar in an attempt to reduce transmission of the vibrations to the weights. Without the dampening material the vibrations would be shared by the weights that generally have a large mass. The lack of isolation of the masses would reduce the effectiveness of providing vibrations to the muscles and require that the vibration source work harder.

SUMMARY OF THE INVENTION

An aspect of an embodiment of the invention, relates to a an exercise device including a vibrational member that is placed in contact with a trainee's body while performing exercise thus transferring vibrational energy to the body of the trainee. Wherein the vibrational member is attached on one or more sides to an aerobic exercise element having an elastic member to perform aerobic exercise while stimulating the trainee with vibrational motion. Alternatively, the vibrational member is attached to an aquatic exercise element having an aquatic member that is designed to resist motion through water. Further alternatively, the vibrational member is attached to weights on one or more sides of the vibrational member to form a barbell. Wherein each weight is constructed from a plurality of small mass units. Each small mass unit is surrounded by a cushioning material. In some embodiments of the invention, the plurality of cushioned small mass units are shaped as cylinders, cubes, or spheres and are placed next to each other on a single surface to form an equal sided polygonal shaped weight, so that the weight will fit into a compartment attached to the end of the elongated bar. Optionally, the plurality of cushioned small mass units are adhesively coupled or wrapped together to form the weight.

In an exemplary embodiment of the invention, the vibrational member is shaped as an elongated bar. In some embodiments of the invention, more than one vibrational member is attached to the exercise elements.

In an exemplary embodiment of the invention, the attachments to the vibrational member are positioned off center, for example the weights or aquatic/aerobic exercise elements on the ends of the vibrational member are attached to a non-centric point on the surface of the weight or exercise element. Optionally, the attachment point of the exercise element attached on one side of the vibrational member is positioned off center in the opposite direction relative to the attachment point of the exercise element on the other side of the vibrational member.

In an exemplary embodiment of the invention, the vibrational member includes a power source embedded therein. Alternatively, the power source may be embedded in one of the attachments to the vibrational member, for example one compartment of the barbell may contain the power source to provide power to the vibration mechanism. Optionally, the power source is one or more batteries. Optionally, the batteries are rechargeable batteries.

In an exemplary embodiment of the invention, the vibrational member includes identical attachments on both sides, for example the weight on both sides of the elongated bar of the barbell are identical and the weight of the compartments are about the same. Alternatively, the attachments of an exercise device having more than one attachment may differ significantly, for example having a different shape or weight.

Optionally, for the barbell the weight of the compartments may differ significantly and the weights used complement each side to reach an equal weight value on both sides. In some embodiments of the invention, the weight of one side differs from the weight of the other side.

In an exemplary embodiment of the invention, the vibrational member or at least one of the attachments to the vibrational member, for example the compartment on at least one side of the barbell, includes a display to provide information to the user, for example the power status or the vibration intensity or frequency. Optionally, the vibration intensity and/or frequency are user controllable by means of switches on the vibrational member or on one of the attachments.

In an exemplary embodiment of the invention, the exercise device includes an activation switch to turn on or off the vibrations. Optionally, the vibration switch is activated by using the exercise device, for example grasping the vibrational member (e.g. in the form of an elongated bar) causing the activation switch to be depressed. In some embodiments of the invention, pulling the vibrational member may cause the attachment to apply a force against the vibrational member that activates the vibrations.

There is thus provided according to an exemplary embodiment of the invention, an exercise device, comprising:

at least one vibrational member that is adapted to vibrate at least a part of the trainee's body;

a power interface adapted to enable powering the vibrational member;

one or more attachments connected to the vibrational member, wherein the attachments include an elastic member or biasing member forming an aerobic exercise device that is adapted to resist the trainee's motion during an aerobic workout;

or wherein the attachments include an aquatic member that is designed to provide buoyancy or resist motion through water forming an aquatic exercise device;

or wherein the attachments are weights forming a barbell and the weights are made up from a plurality of small unit masses, each unit mass cushioned by a cushioning material.

In an exemplary embodiment of the invention, the vibrational member is shaped as an elongated bar. Optionally, the attachments are positioned off center at their connection points to the vibrational member. In an exemplary embodiment of the invention, the attachment on one side is positioned off center in the opposite direction as the attachment on the other side of the vibrational member. Optionally, the power interface is located in the vibrational member. Alternatively, the power interface is located in one of the attachments connected to the vibrational member. In an exemplary embodiment of the invention, the total weight of the attachment with the power interface is substantially the same as the weight of the other attachments. Optionally, the attachments are identical.

In an exemplary embodiment of the invention, the attachments differ in properties selected from the group consisting of weight, size, form, buoyancy, elasticity, and conductivity. Optionally, the vibrational member includes an activation switch that is activated by exercising with the exercise device.

In an exemplary embodiment of the invention, the properties of the vibrations are user controllable. Optionally, the controllable properties of the vibrations are selected from the group consisting of frequency, intensity, amplitude, duration, direction and pattern. In an exemplary embodiment of the invention, the force required to be applied by the user to use the exercise device is user controllable. Optionally, the vibrational member is detachable.

In an exemplary embodiment of the invention, the attachments are detachable. Optionally, the vibrational member is encapsulated in a water proof encapsulation. In an exemplary embodiment of the invention, the plurality of small unit masses are wrapped together in a single plane. Optionally, the attachments include anchors to anchor the exercise device to non movable objects during use of the exercise device. In an exemplary embodiment of the invention, the vibrational member further comprises an electrical muscle stimulator. Optionally, the electrical muscle stimulator is activated simultaneously with the vibrations by the vibrational member.

In an exemplary embodiment of the invention, the exercise device further comprises a power source that is charged by performing exercise with the exercise device. Optionally, the vibrational member further comprises sensors to monitor the exercise device. In an exemplary embodiment of the invention, the vibrational member further comprises one or more elements selected from the group consisting of: a CPU, a display, a memory, control buttons, an input circuit, an output circuit and a control circuit.

BRIEF DESCRIPTION OF THE DRAWINGS

The present invention will be understood and better appreciated from the following detailed description taken in conjunction with the drawings. Identical structures, elements or parts, which appear in more than one figure, are generally labeled with the same or similar number in all the figures in which they appear, wherein.

DETAILED DESCRIPTION

Figure 1A:
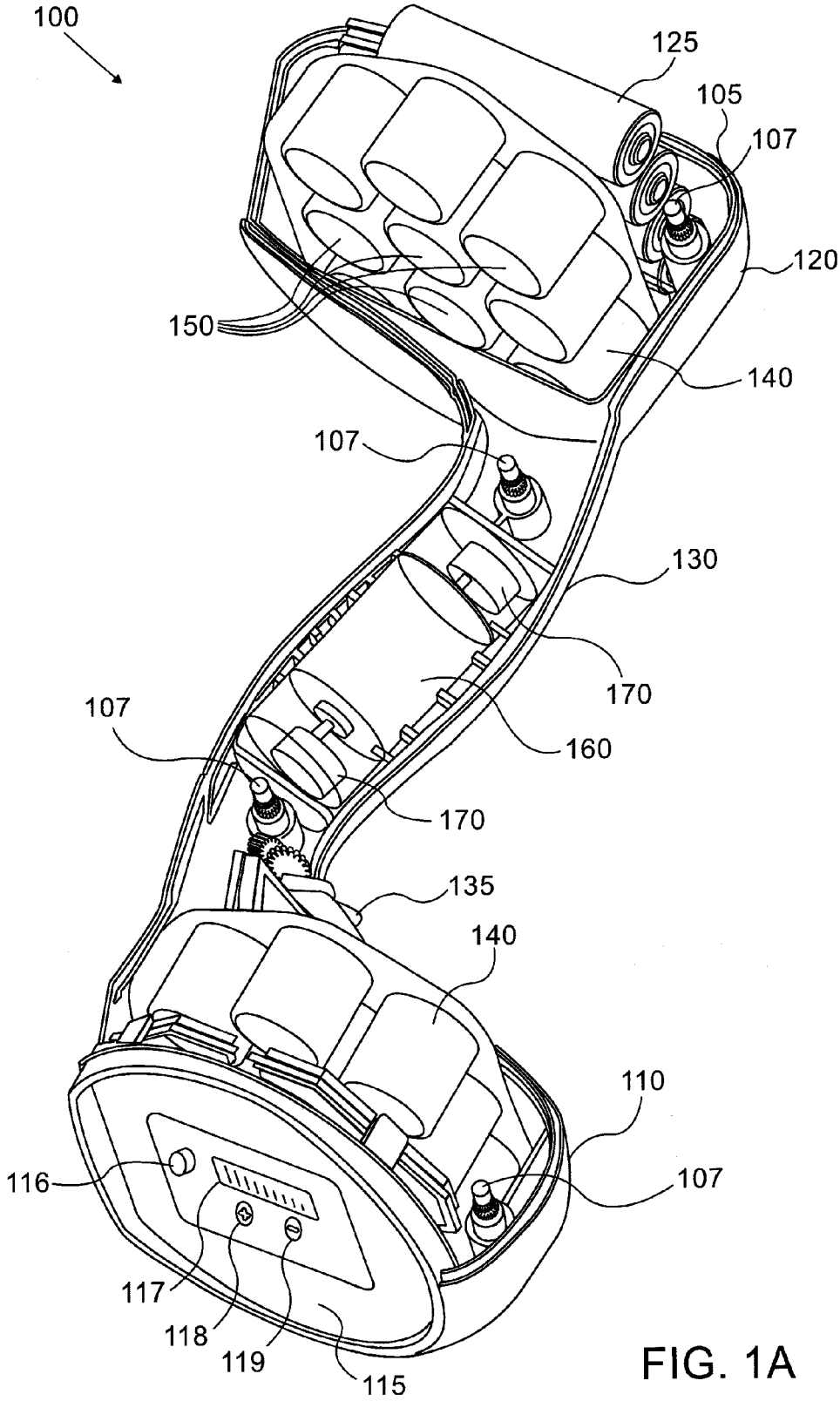
FIG. 1A is a schematic illustration of a cross sectional view from a first end of a barbell, according to an exemplary embodiment of the invention.
Figure 1B:
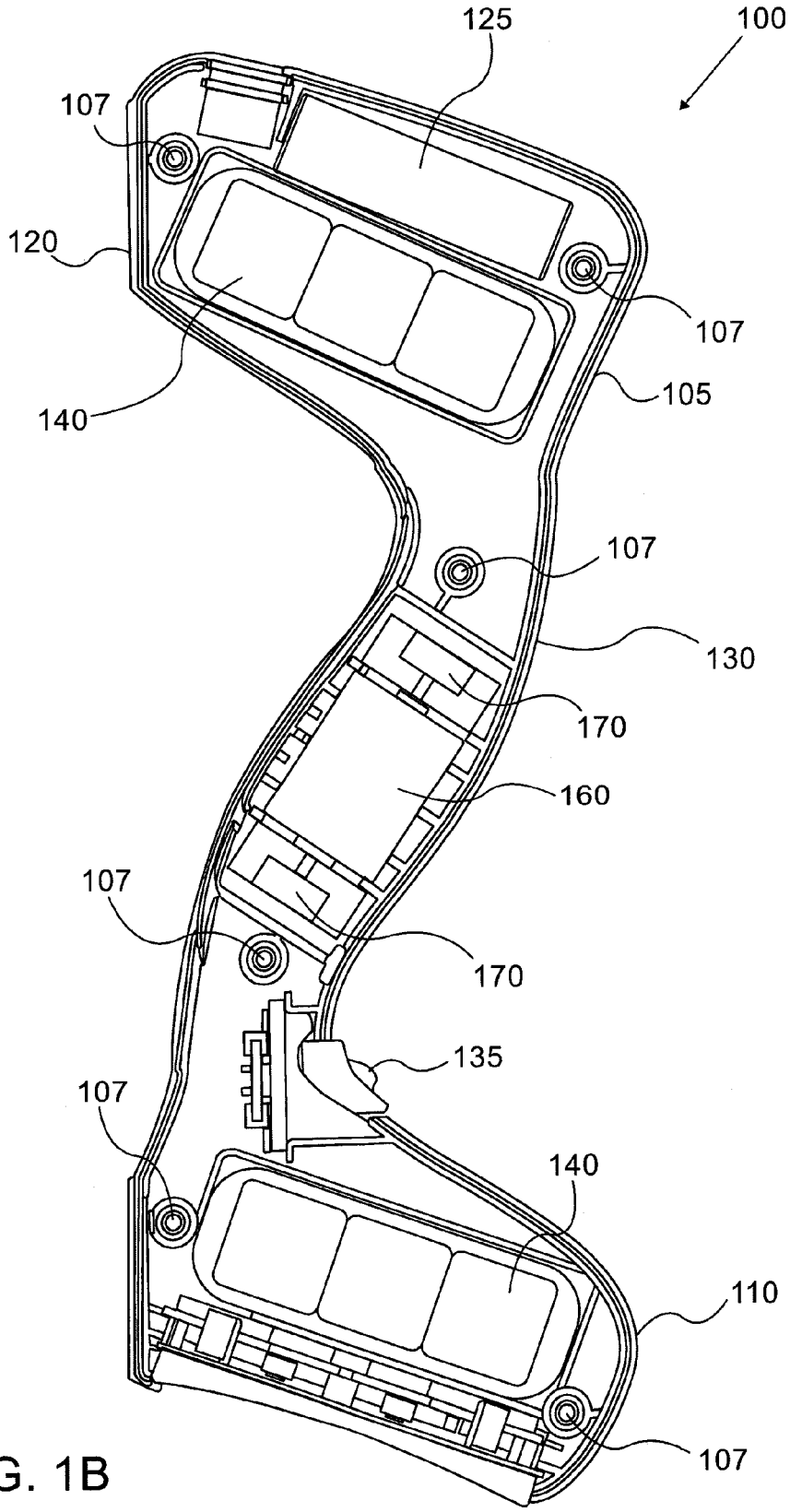
FIG. 1B is a schematic illustration of a cross sectional side view of a barbell, according to an exemplary embodiment of the invention.
Figure 1C:
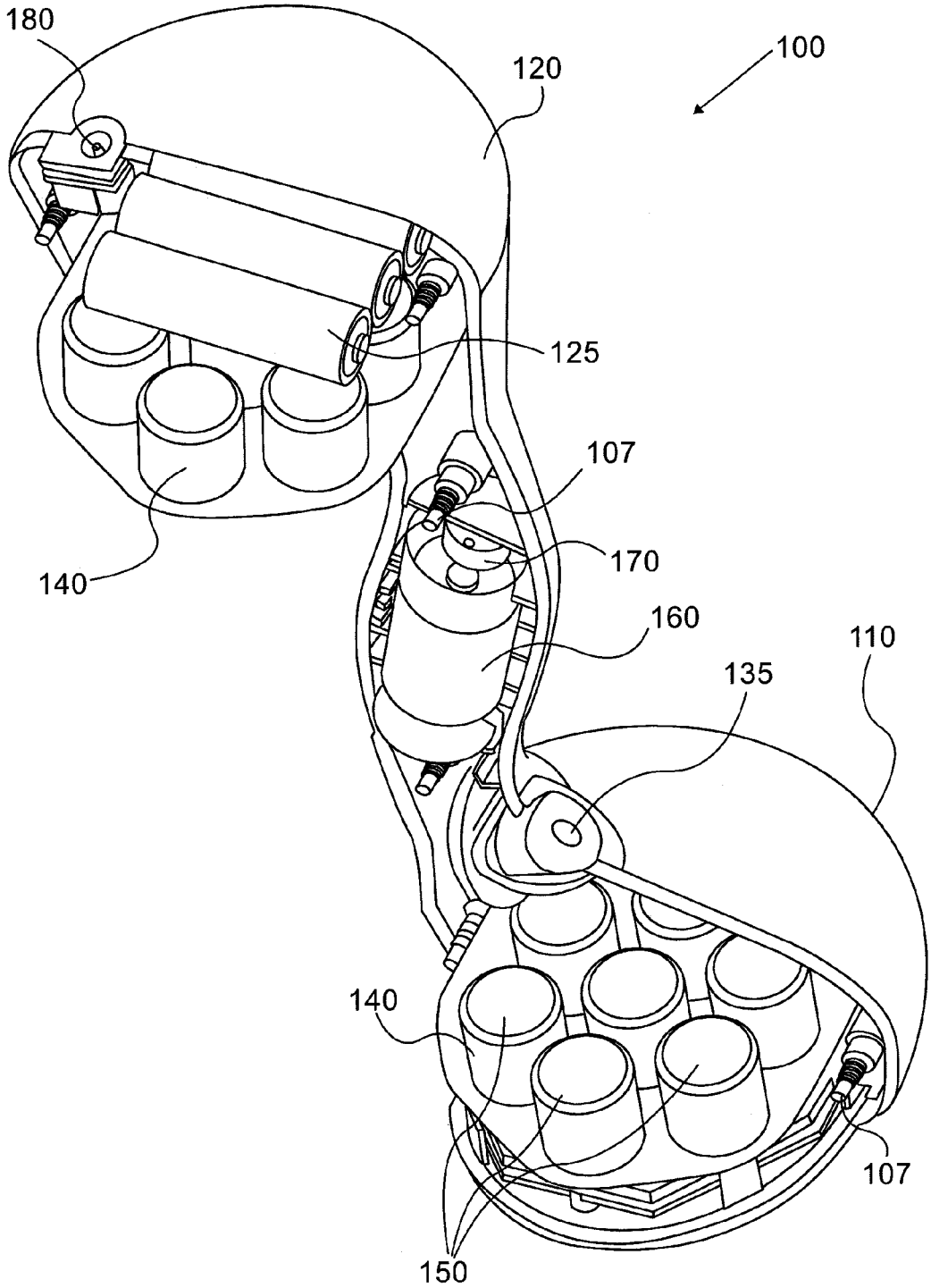
FIG. 1C is a schematic illustration of a cross sectional view from a second end of a barbell, according to an exemplary embodiment of the invention.

FIG. 1A is a schematic illustration of a cross sectional view from a first end 110 of a barbell 100, according to an exemplary embodiment of the invention, FIG. 1B is a schematic illustration of a cross sectional side view of barbell 100, according to an exemplary embodiment of the invention, and FIG. 1C is a schematic illustration of a cross sectional view from a second end 120 of barbell 100, according to an exemplary embodiment of the invention;

In an exemplary embodiment of the invention, barbell 100 includes an elongated bar 130 connecting between the first end 110 and the second end 120. Optionally, both ends are made up from a compartment for holding various elements as described below. In an exemplary embodiment of the invention, the first end 110 and second end 120 both hold a weight 140 that is made up from a plurality of small mass units 150 that are each surrounded by a cushioning material, for example a weight with a mass of 1 Kg may be divided into 10 small mass units 150 of 100 Grams each.

In an exemplary embodiment of the invention, the cushioned small mass units 150 may be assembled in a specific shaped formation and glued together or wrapped together to form weight 140, for example forming an equal sided polygon of 4-10 sides in a single plane. The shape of the polygon is selected to match the shape of the encasement into which weight 140 needs to be inserted.

Optionally, each mass unit 150 may be shaped as a cube, a cylinder or sphere or have any other shape to enable placement of the mass units in a formation with a specific shape as required by the encasement.

In an exemplary embodiment of the invention, the mass units are made from a heavy material (e.g. various metals or minerals). The cushioning material is made from a soft light material (e.g. various cloths), or a foamy or sponge like material (e.g. foamed plastic) to absorb vibrations.

In an exemplary embodiment of the invention, elongated bar 130 serves as a vibrational member by encasing a vibrating element, for example an electrical motor 160 with unbalanced masses 170 connected to opposite sides of the motor 160 or an unbalanced rotor that causes the motor 160 to vibrate. In an exemplary embodiment of the invention, the motor produces vibrations that can stimulate the users muscles, for example causing elongated bar 130 to vibrate with an amplitude of 0.1 to 1.5 mm at a frequency of 1 to 100 HZ. Optionally, the vibrations of the motor will be absorbed by the muscles of a user grasping the elongated bar 130. In an exemplary embodiment of the invention, the cushioning surrounding the small mass units 150 will prevent them from absorbing the vibrations from the motor 160, so that the vibrations will be mainly absorbed by the user. In an exemplary embodiment of the invention, by dividing the weights of the barbell into smaller weights that are each padded enhances the absorption of the vibration and prevents them from being wasted on the weights.

In some embodiments of the invention, the vibrations are created by other mechanisms as known in the art.

In an exemplary embodiment of the invention, the second end 120 includes a power source 125, which may include batteries. In some embodiments of the invention the batteries are rechargeable. Optionally, barbell 100 is provided with a power socket 180 to allow attachment of a transformer to power barbell 100 during use or to charge the batteries and use the barbell 100, when it is not being charged. In some embodiments of the invention, power source 125 may be positioned inside elongated bar 130 instead of in the second end 120.

In an exemplary embodiment of the invention, the first end 110 includes a control panel 115, to control the intensity of the vibrations. Optionally, control panel 115 includes an on/off switch 116 to activate the vibration motor 160, a display 117 to show the selected intensity and or charge status of the power source 125, a plus button 118 and a minus button 119 to increase or decrease the intensity and/or frequency of the vibrations by controlling motor 160. In some embodiments of the invention, an activation switch 135 is positioned on elongated bar 130 and activated when a user grasps elongated bar 130 and exerts pressure on activation switch 135, thus the vibration are activated only when using barbell 100 to perform exercise. Optionally, activation switch 135 may be in addition to or instead of on/off switch 116, for example on/off switch 116 may turn on the power to barbell 100 but the vibrations are only activated when a user grasps barbell 100 and presses on activation switch 135.

In an exemplary embodiment of the invention, first end 110 may be designed to have the same weight as second end 120, for example by having the weight of the display to be approximately the same as the weight of the batteries. Optionally, weights 140 of identical weight are inserted into both ends. Alternatively, one end may be heavier than the other and non identical weights are placed on each end to equate the weight of both the ends. Further alternatively, the weight of both the ends may differ, for example to form a non-symmetrical barbell.

In some embodiments of the invention, elongated bar 130 is attached off the center of first end 110 and/or second end 120. Optionally, first end 110 and second end 120 are attached so that they lean in opposite direction as shown in FIG. 1A to enhance the utilization of specific muscles of the user's hand that need to counteract the torque introduced by forming a non-symmetrical barbell. Alternatively, first end 110 and second end 120 may be attached symmetrically as in standard barbells.

In some embodiments of the invention, elongated bar 130 may be designed with an ergonomic shape to enhance the user's grasp of the bar. Optionally, elongated bar 130, first end 110 and second end 120 may all be connected together by a single cast encasement 105. Optionally, encasement 105 may include two halves with pins 107 on one end and matching sockets on the other end to close encasement 105.

Figure 1D:
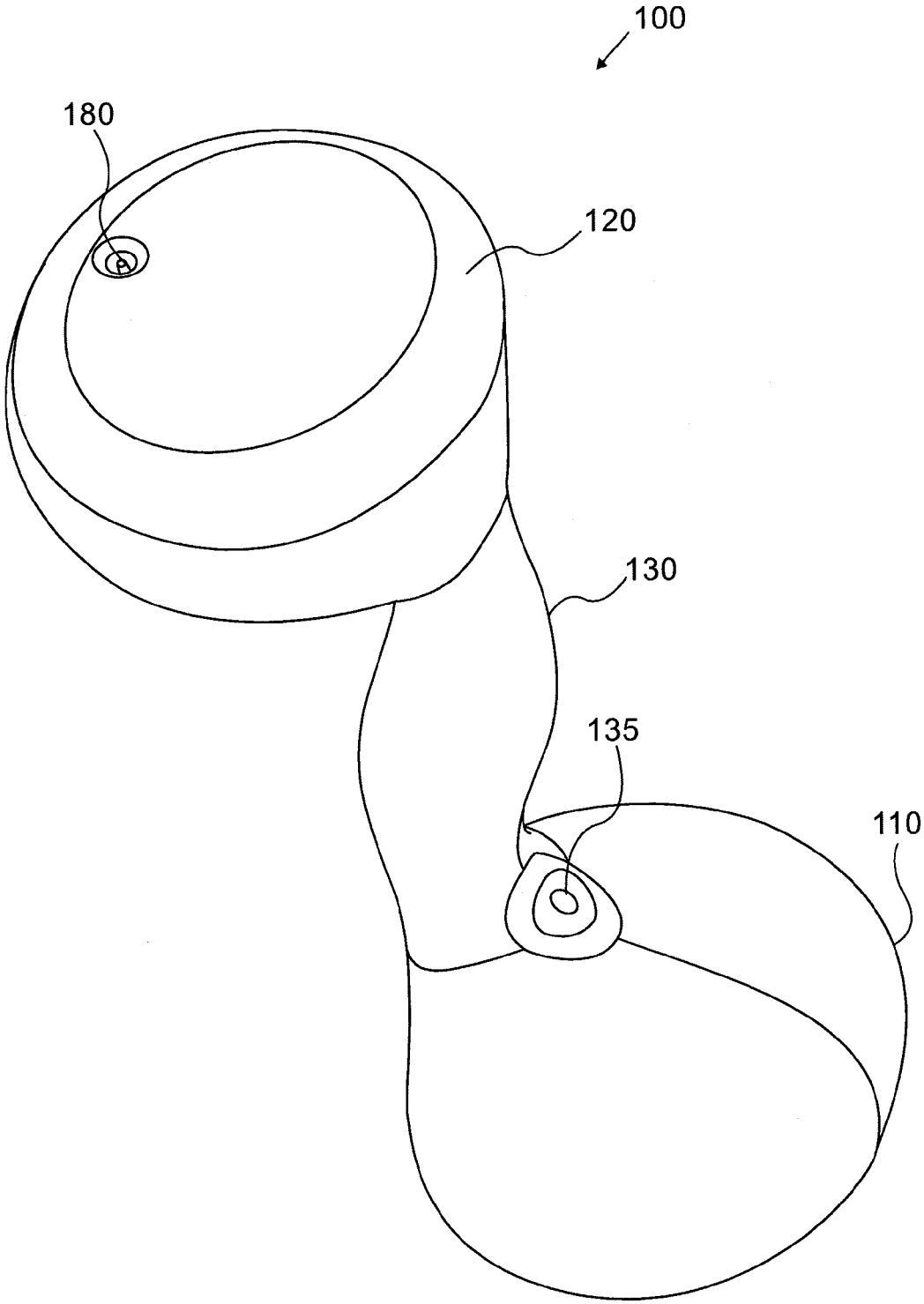
FIG. 1D is a schematic illustration of a perspective view of a barbell, according to an exemplary embodiment of the invention.

FIG. 1D is a schematic illustration of a perspective view of barbell 100, with both halves of encasement 105 deployed, enclosing over the inner elements described above, according to an exemplary embodiment of the invention.

Figure 2:
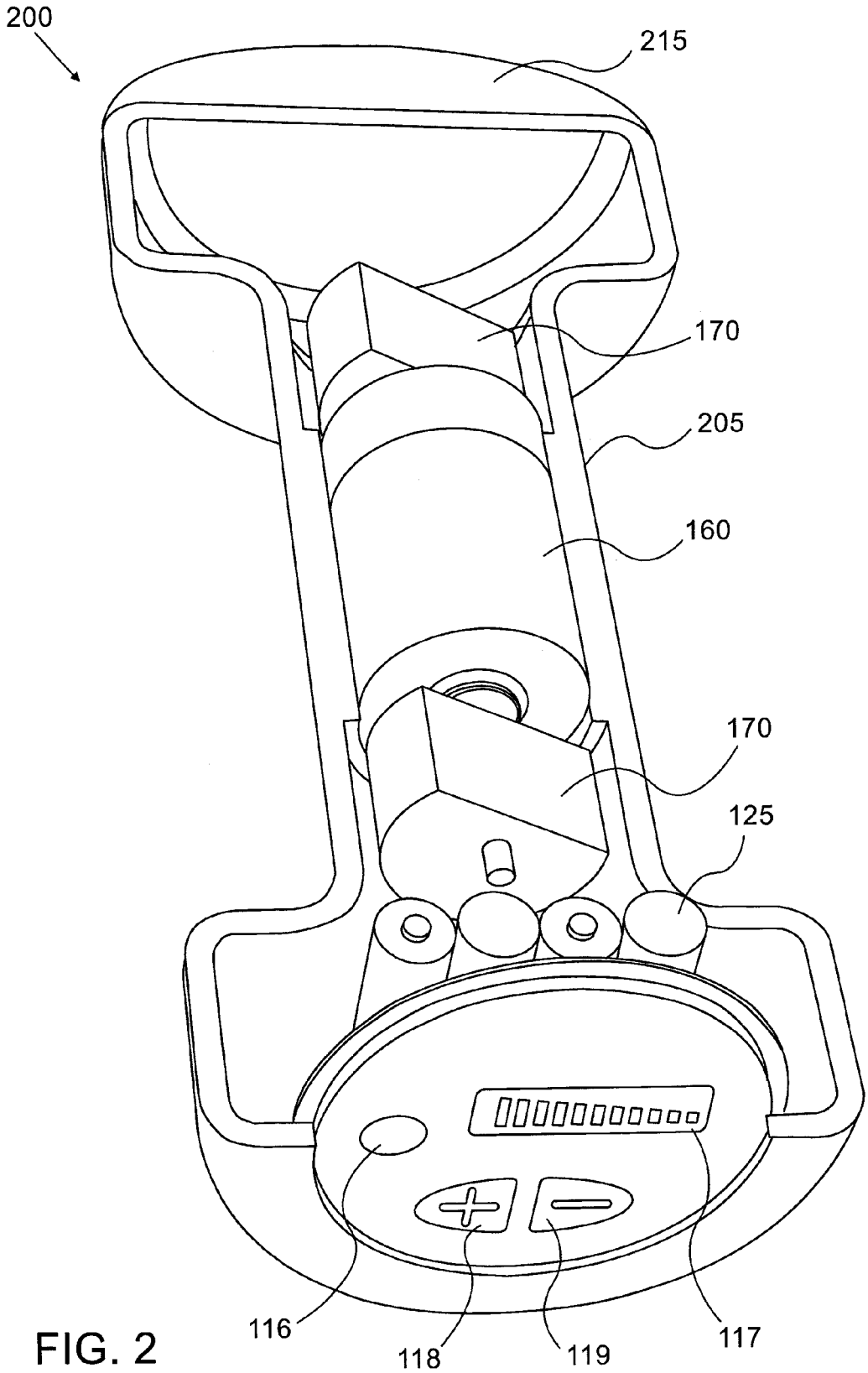
FIG. 2 is a schematic illustration of a cross sectional view of an alternative barbell, according to an exemplary embodiment of the invention.

FIG. 2 is a schematic illustration of a cross sectional view of an alternative barbell 200, according to an exemplary embodiment of the invention. Barbell 200 is formed with a standard barbell shape. In an exemplary embodiment of the invention, in barbell 200 the batteries are placed on the same end as the display and switches in an encasement 205. Optionally, the bottom of encasement 205 is provided with a weight 215 to equate between the weights of both ends of barbell 200. In an exemplary embodiment of the invention, both ends of encasement 205 are designed to leave room to insert weight 140 with cushioned small mass units 150 as described above.

Figure 3:
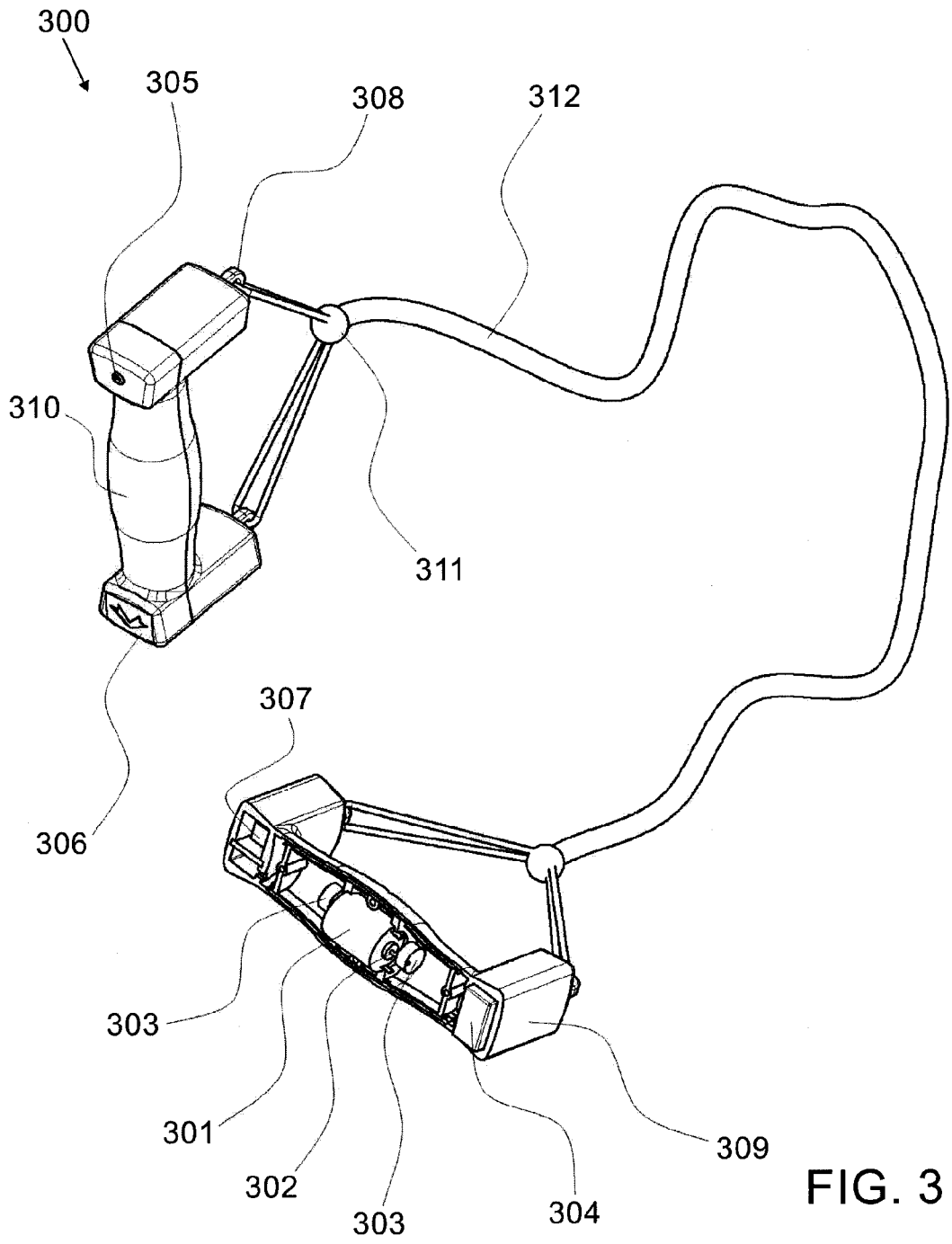
FIG. 3 is a schematic illustration of an aerobic exercise device in the form of a stretch band including vibrational members in the form of handles and a flexible resistance cable, according to an exemplary embodiment of the invention.
Figure 4:
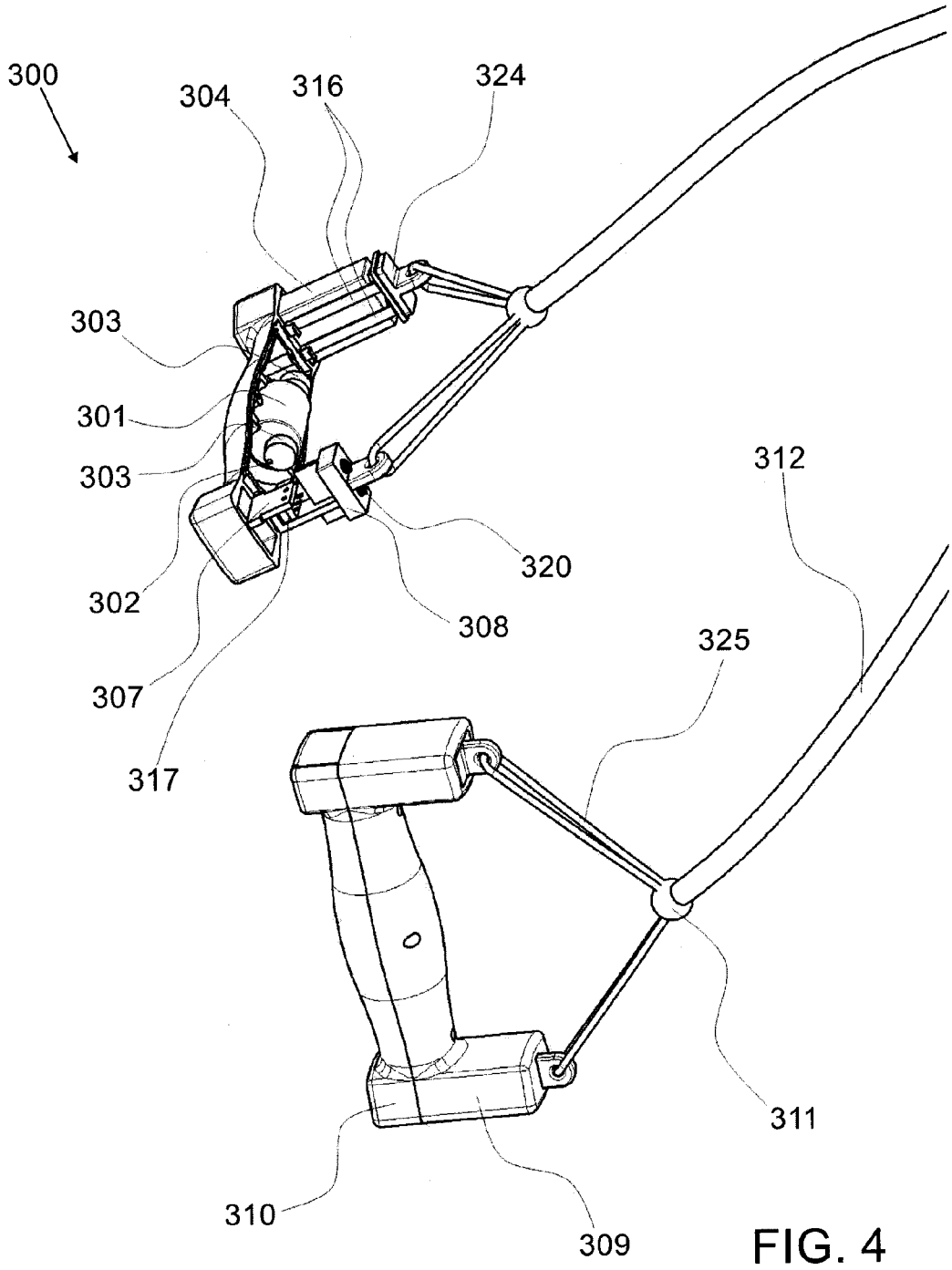
FIG. 4 is a schematic illustration of an alternative view of an aerobic exercise device in the form of a stretch band including vibrational members in the form of handles and a flexible resistance cable, according to an exemplary embodiment of the invention.

FIG. 3 is a schematic illustration of an aerobic exercise device 300 in the form of a stretch band including vibrational members in the form of handles 309+310 and a flexible resistance cable 312, according to an exemplary embodiment of the invention; and FIG. 4 is a schematic illustration of an alternative view of aerobic exercise device 300 in the form of a stretch band including vibrational members in the form of handles 309+310 and a flexible resistance cable 312, according to an exemplary embodiment of the invention.

In an exemplary embodiment of the invention, aerobic exercise device 300 includes the following elements (shown in FIG. 3 and/or FIG. 4):

301—motor;
302—Shaft;
303—Un-balanced weights;
304—Power source;
305—Charging socket;
306—Power source replacement cover;
307—Structure containing the strain operation switch;
308—Connector to 311 and 309;
309—Lower part of the handle casing;
310—Upper part of the handle casing;
311—Connector between flexible resistance cable 312 and connectors 308, 324;
312—Flexible resistance cable;
316—Wiring/conductors;
317—Switch/micro switch;
320—Springs;
324—Connector between cable 325 and lower part of handle 309;
325—Connecting cable between 311, 312 and 308, 324.

In an exemplary embodiment of the invention, the handle casing 309+310 contains the basic elements of the vibration system. The power source 304, located inside the handle 309+310, supply the motor 301 with the required energy to rotate the un-balanced weights 303. The motor shaft 302 connects the motor 301 to the ex-center of the weights 303 creating an unbalanced rotation motion forming vibrations.

This optional embodiment of the vibrating system can be replaced with other types of vibration systems or stimulators known in the art such as a solenoid, a crank shaft, a piezoelectric element, an EMS (Electronic Muscle Stimulator) and the like. Other stimulators can be added or included with the handles to enhance the workout, including more vibration sources, heaters and coolers, EMS and the like.

The power source 304 can be charged using the charging socket 305 or be replaced. By shifting the power source replacement cover 306, the emptied power source 304 can be removed and replaced with a charged power source. The power source 304 can be a battery, capacitor or any other type of electrical power source suited for the system.

The structure containing the strain operation switch 307 is mounted inside the handle 309+310. Once the resistance cable 312 is stretched, the switch (shown in FIG. 4) connected to 307 is pressed against the inside structure (shown in FIG. 4.) of connector 308 and activates the vibration system (301, 302, 303, 304). The activation level can be set and modified as needed.

The connector 308 anchors the resistance cable 312 through connector 311 to the handles.

The resistance cable 312 uses the two connectors 311 to be attached to the handles 309+310.

The flexible resistance cable 312 provides stretching resistance during workout. The cable 312 can be made from rubber, silicon, metal, nylon or any other material that can form a resistance force in its shape, including tube, band, spring, interwoven or any other shape that can be stretched, against the stretching action. The cable 312 can provide various resistance levels according to its features and be replaced with other structures to accommodate various needed behaviors like resistance to pushing (like a piston), resistance to pulling (like a spring), change resistance level (by replacing, adding or subtracting the number and types of structures) and the like to provide resistance to muscles during workouts.

When the flexible resistance cable 312 is resisting its stretching, the structure of the connector 308 activates a switch 317. Switch 317 is mounted on structure 307 that is assembled into the handle lower part 309 and thus not moving while enabling the pushing of the switch 317.

When the switch 317 is activated, the power source 304 can deliver electricity through the wiring 316 to the motor 301. The motor 301 rotates the un-balanced weights 303 using the motor shafts 302 creating a vibration.

When the flexible resistance cable 312 is relaxed (not stretched) springs 320 between connector 308 and the handle lower part 309, are pushing the connector 308 towards the handle upper part 310 while releasing the pressure from the switch 317. When the switch 317 isn't pressed, the power source 304 can't deliver electricity thus disabling vibration.

The connector 325 connects the flexible resistance cable 312 through the connectors 308 and 324 to the handle 309+310.

Figure 5:
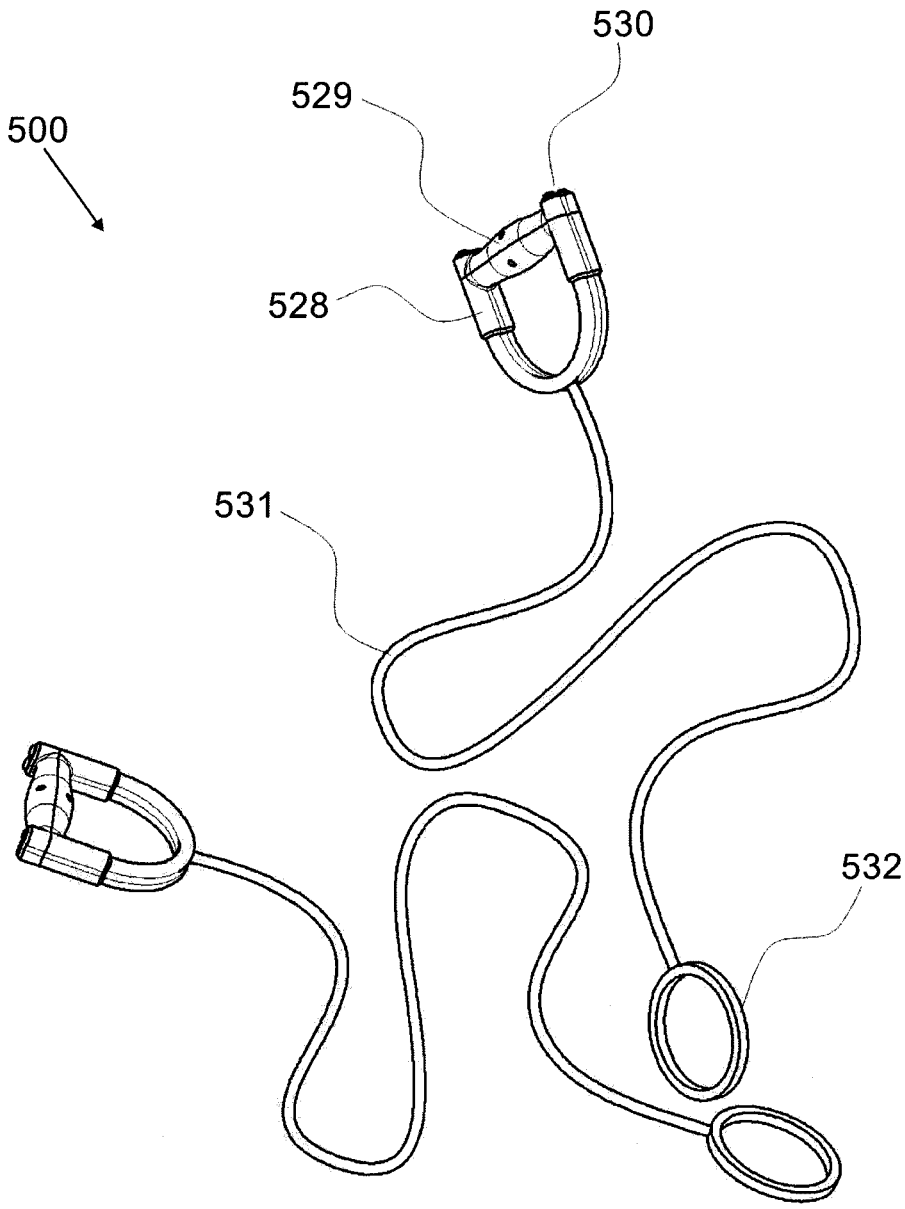
FIG. 5 is a schematic illustration of an alternative aerobic exercise device in the form of stretch bands including vibrating sources, a flexible resistance cable, handles and anchors, according to an exemplary embodiment of the invention.

FIG. 5 is a schematic illustration of an alternative aerobic exercise device 500 in the form of stretch bands including vibrating sources, a flexible resistance cable 531, handles and anchors, according to an exemplary embodiment of the invention;

In an exemplary embodiment of the invention, aerobic exercise device 500 includes the following elements:

528—Lower part of the vibrating handles;
529—Upper part of the vibrating handles;
530—Control system;
531—Flexible resistance cable;
532—Anchors/attachments.

Using the control system 530 on top of the handles 529 the user can controls the activation and the features (frequency, speed and the like) of the vibrating system. The control system can include a monitor to display the required information. Inside the handles 528+529, along with the vibrating system and the power source, a circuit board (not shown) can be positioned. The circuit board can include a CPU, memory, input & output modules, sensors and the like, to control and monitor the system. The control system can recommend a workout while tracing the activity. The data can be uploaded and download to and from a PC for logging.

The handles 528+529 can include a strain gauge (not shown) connected to the flexible resistance cable 531 to activate the included vibration or stimulation system while the flexible resistance cable 531 is being stretched.

The anchors 532 connected to the flexible resistance cable 531 are used to affix the flexible resistance cable 531 to the surroundings (including the user foot, doors and the like).

Figure 6:
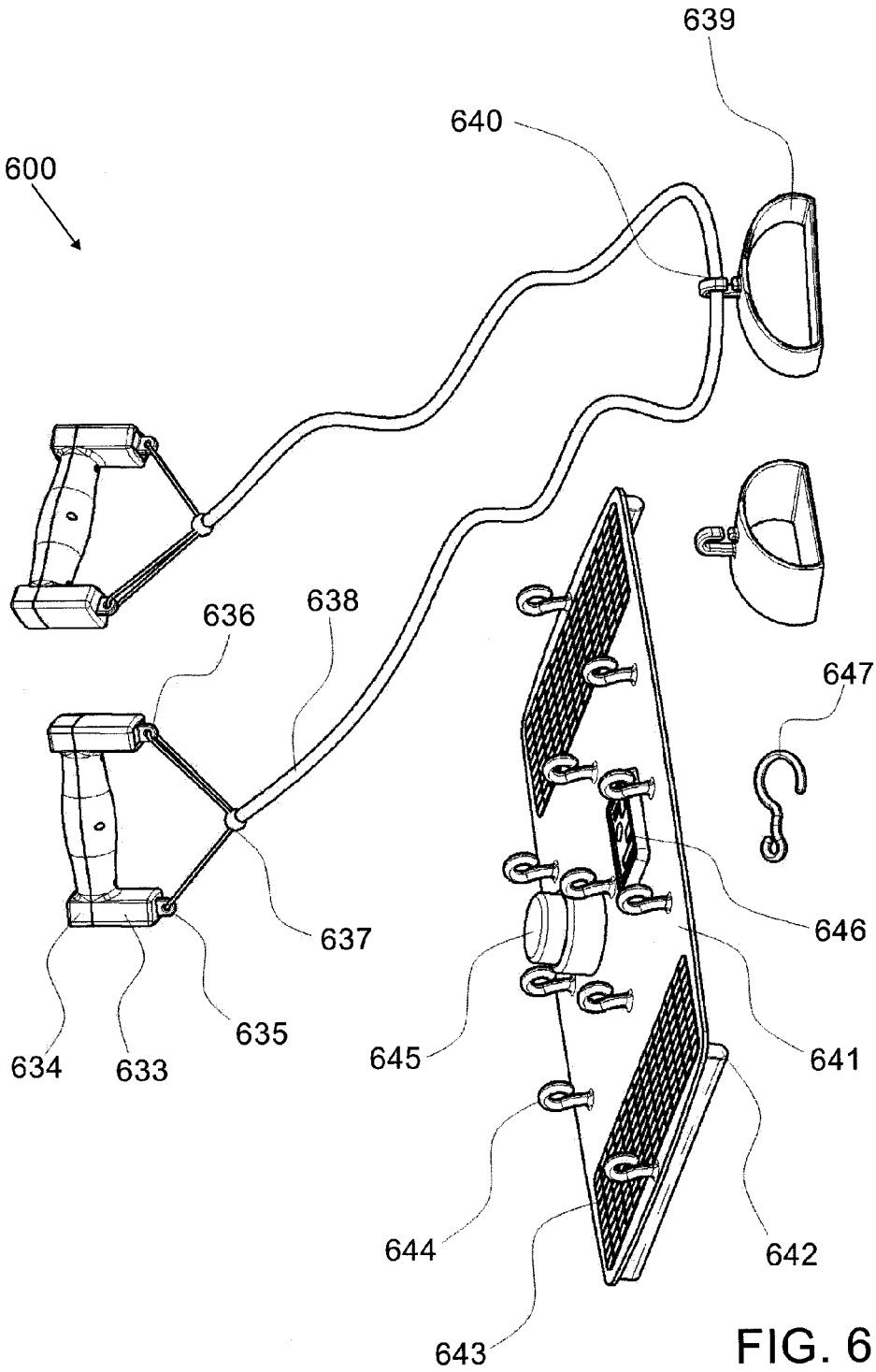
FIG. 6 is a schematic illustration of an alternative aerobic exercise device in the form of stretch bands including vibrating handles, a flexible resistance cable, and a vibrating workout plate with multiple anchors, according to an exemplary embodiment of the invention.

FIG. 6 is a schematic illustration of an alternative aerobic exercise device 600 in the form of stretch bands including vibrating handles, a flexible resistance cable, and a vibrating workout plate 641 with multiple anchors 644, according to an exemplary embodiment of the invention;

In an exemplary embodiment of the invention, aerobic exercise device 600 includes the following elements:

633—Lower part of the vibrating handles;
634—Upper part of the vibrating handles;
635—Activation connector between 637 and 633;
636—Connector between 637 and 633;
637—Connector between 638 and 635, 636;
638—Flexible resistance cable;
639—Foot anchors/attachments;
640—Connector between 639 and 638;
641—Vibrated plate;
642—Floor stands;
643—Foot stands;
644—Anchors;
645—Vibrating source;
646—Control panel;
647—Anchor;

The vibrated plate 641 is an addition to the vibrated exercise stretch bands 634-640 or can be used as stand-alone.

The vibrated plate 641 includes a vibrating source 645 that compromise at least one vibration source to vibrate the plate 641. The control panel 646 of the vibrated plate 641 can control the vibration type, frequency, intensity and other features. The control panel 646 can also present and recommend workouts while monitoring the activity. Another feature of the control panel is to convert music sound waves, delivered from music sources like iPod and the like, into various frequencies and intensities. The vibrated plate 641 surface can be made from semi flexible material in order to deliver more efficiently the vibration from the vibration source 645 to the user. The user can position his foot on top of the foot stands 643 while anchoring the flexible cable 638 to the vibrating plate 641 using one of the anchors 644, or to his foot by positioning his foot inside the foot anchors 639 and connecting it using the anchor 640 to the flexible cable 638.

The vibrated plate 641 floor stands 642 can include other stimulators like EMS and be positioned optimally to enable minimal interference with the vibration of the vibrated plate 641.

The vibrated flexible cable handles 633, 634 can deliver vibration or stimulation (like electric pulses) in addition to the vibrated plate 641-646 or as a stand alone device. While the flexible cable 638 is being stretched, the handle vibration and stimulation can be activate using the pressure delivered on the internal switch connected to the connector 635 that has been described in FIGS. 3-4.

The flexible cable 638 is connected to the handle 633, 634 using the connectors 635, 636, 637.

An additional anchor/connector 647 can be added to attach the flexible cable 638 to the surroundings.

Figure 7:
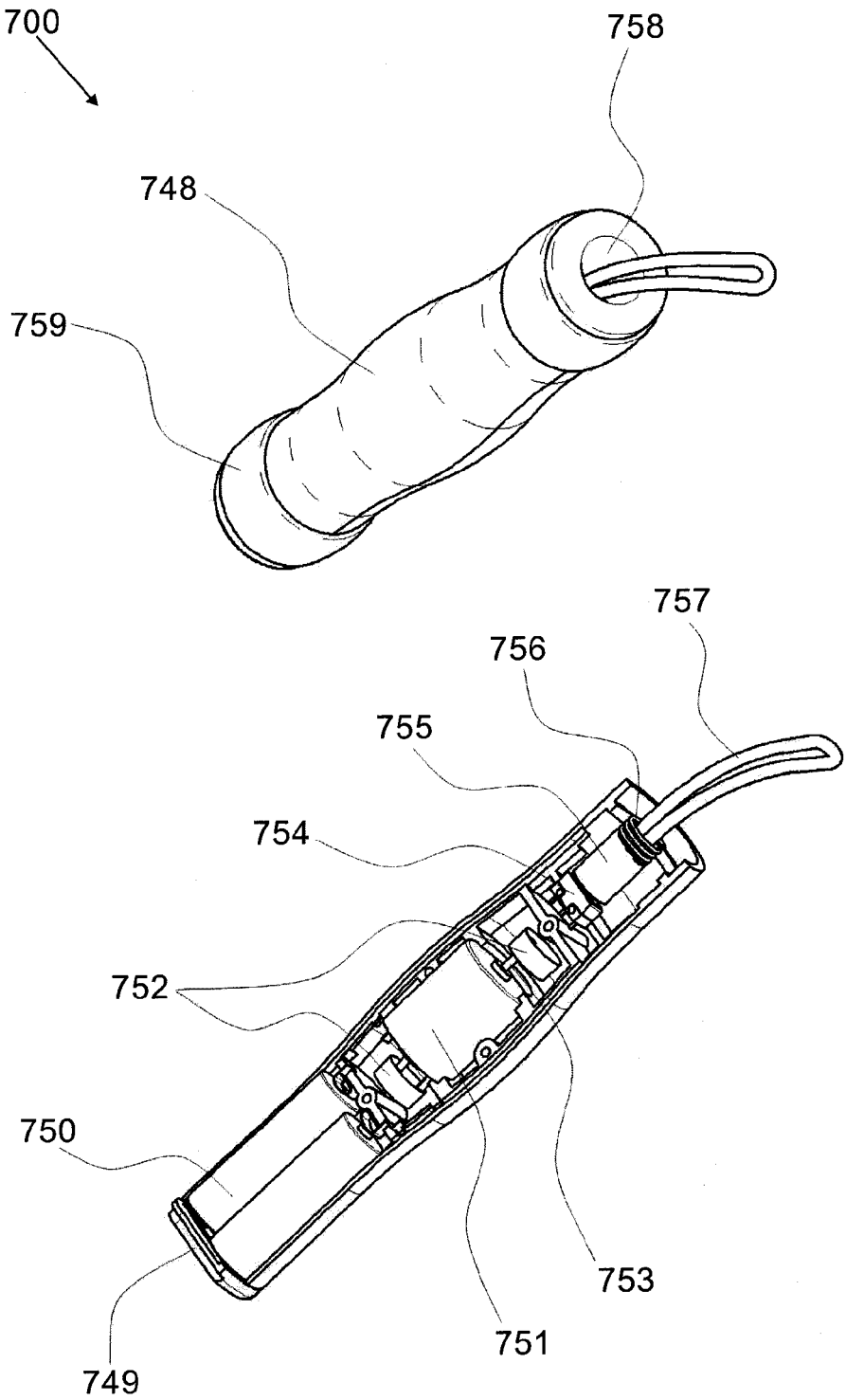
FIG. 7 is a schematic illustration of an alternative vibrating handle for use in an aerobic exercise device, according to an exemplary embodiment of the invention.

FIG. 7 is a schematic illustration of an alternative vibrating handle 700 for use in an aerobic exercise device, according to an exemplary embodiment of the invention;

In an exemplary embodiment of the invention, vibrating handle 700 includes the following elements:

748—Handle;
749—Power source charging socket or replacement cap;
750—Power source;
751—Motor;
752—Un-balanced weights;
753—Shaft;
754—Switch/micro-switch;
755—Pressurized knob;
756—Loaded spring;
757—Connection loop;
758—Conical entrance;
759—Rubber band.

In an exemplary embodiment of the invention, handle 748 can be connected to various elements, including but not limited to weights, a jumping rope, a flexible resistance cable and the like.

The power source 750 can activate the motor 751 to rotate the un-balanced weights 752 using the motor shaft 753 once the switch 754 isn't being pressed.

The connection loop 757 is connected to the knob 755 that is being pressurized by the loaded spring 756. The knob 755 disables the vibration by pressing the switch 754. Once the connection loop 757 is pulled, the knob 755 stops pressing the switch 753 while activating the vibration system. Once the connection loop 757 is relaxed, the loaded spring 756 is pressing the knob 755 on to the switch 754 while disabling the vibration.

This activation method can be replaced by other methods including control buttons, sensors, voice and the like.

The conical entrance 758 allows the outer side of the connection loop 757 to be pulled in any direction.

The rubber bands 759 prevents the user's hand from slipping off the handle during the workout.

Figure 8:
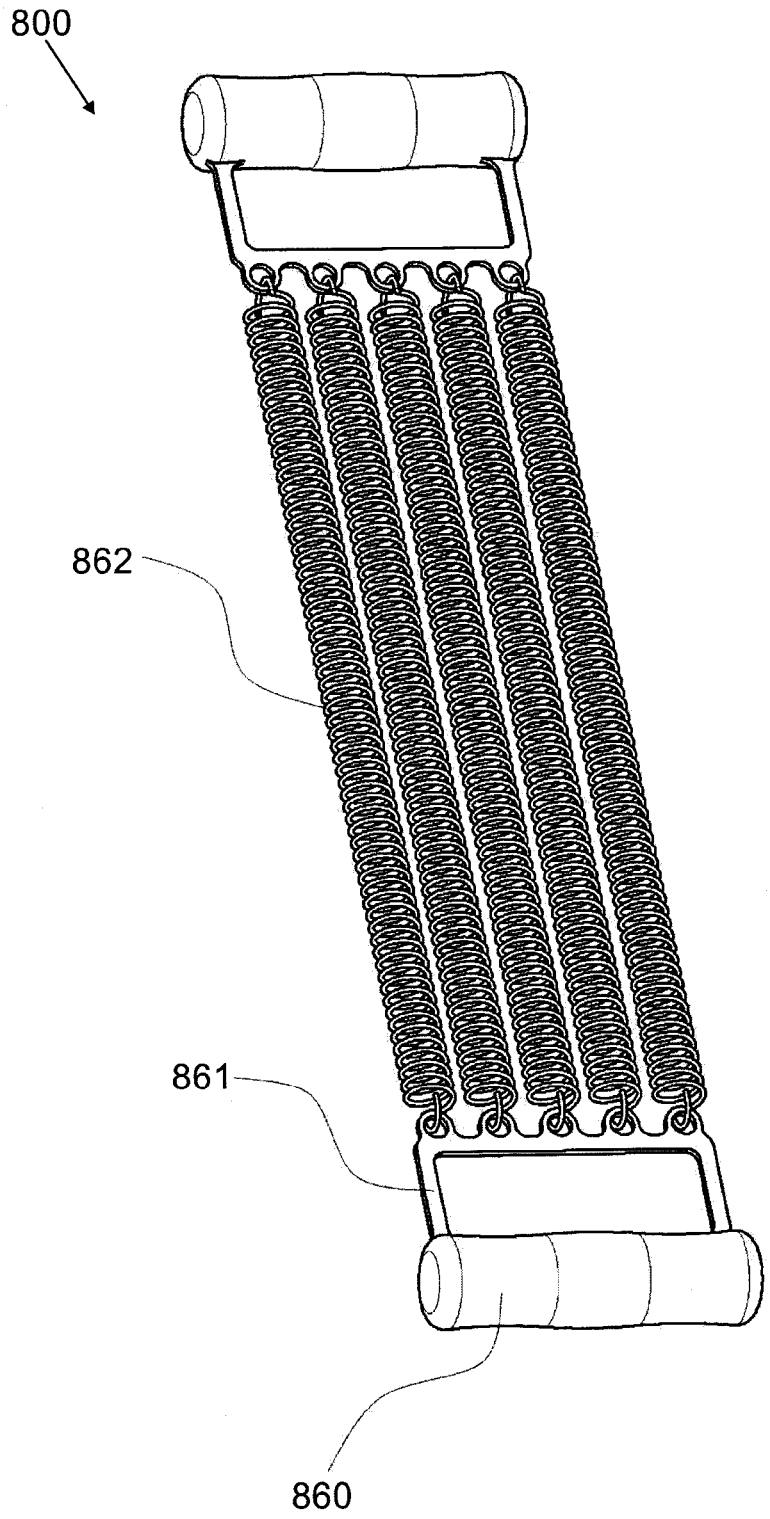
FIG. 8 is a schematic illustration of an alternative aerobic exercise device fitted with chest expander spring resistance, according to an exemplary embodiment of the invention.

FIG. 8 is a schematic illustration of an alternative aerobic exercise device 800 fitted with chest expander spring resistance, according to an exemplary embodiment of the invention.

In an exemplary embodiment of the invention, aerobic exercise device 800 includes the following elements:

860—Vibrated handles;
861—Connector between 60 and 62;
862—Springs.

The vibrating handles 860 can enhance the workout with the chest expander by adding vibration or stimulation (like EMS) during the workout expanding the springs 862.

The connector 861 is used to fit the springs 862 with the vibrating handles.

The springs 862 can be replaced with one or more flexible resistance cables, rubber bands, a piston (like a bullworker) and any other fitted materials and constructions.

Figure 9:
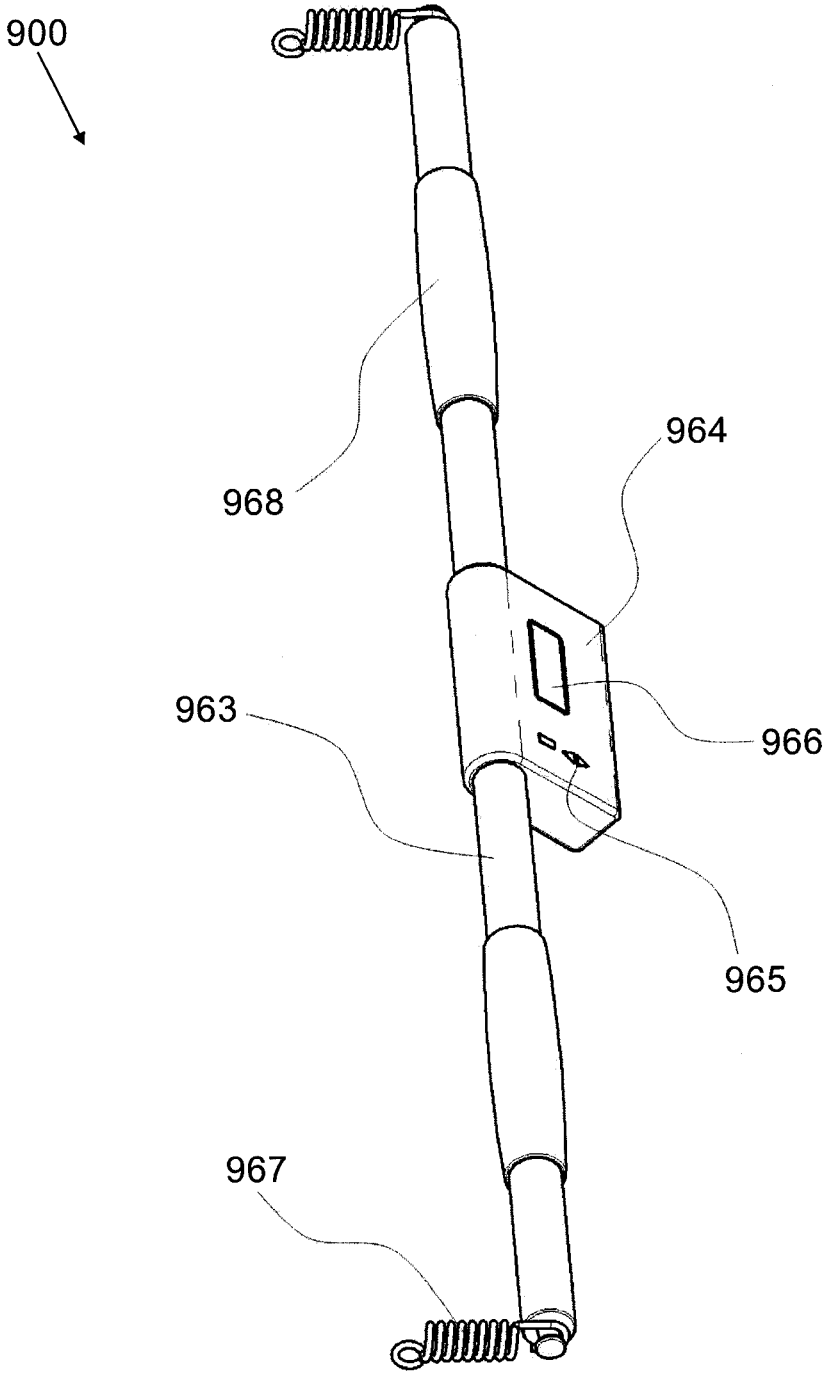
FIG. 9 is a schematic illustration of an alternative aerobic exercise device including a pull up bar with a vibrating system, according to an exemplary embodiment of the invention.

FIG. 9 is a schematic illustration of an alternative aerobic exercise device 900 including a pull up bar with a vibrating system, according to an exemplary embodiment of the invention.

In an exemplary embodiment of the invention, aerobic exercise device 900 includes the following elements:

963—Length adjustable pull up bar;
964—Control system and vibration source;
965—Control buttons;
966—Display;
967—Anchoring springs;
968—No slip hand grippers.

The control system with the vibration source 964 delivers vibration through the pull up bar 963 during workout. The control buttons 965 and the display 966 can recommend a workout; change the vibration frequency, intensity and duration while monitoring the process using sensors. The pull up bar 963 can be mounted using the anchoring springs 967 or by expanding the bar between structures (like lintels).

The springs 967 and the vibration buffers at the ends of the length adjustable pull up bar (not shown at the end of 963) are used as an isolator to prevent the loss of vibration while anchoring the system to a solid structure. The springs 967 and the buffers can be replaced with other fitted materials and structures that will prevent the loss of vibration during the anchoring of the system.

The no slip hand grippers 968 can include other stimulator, instead of or as an addition to the vibration 964, like EMS to enhance the workout.

Figure 10:
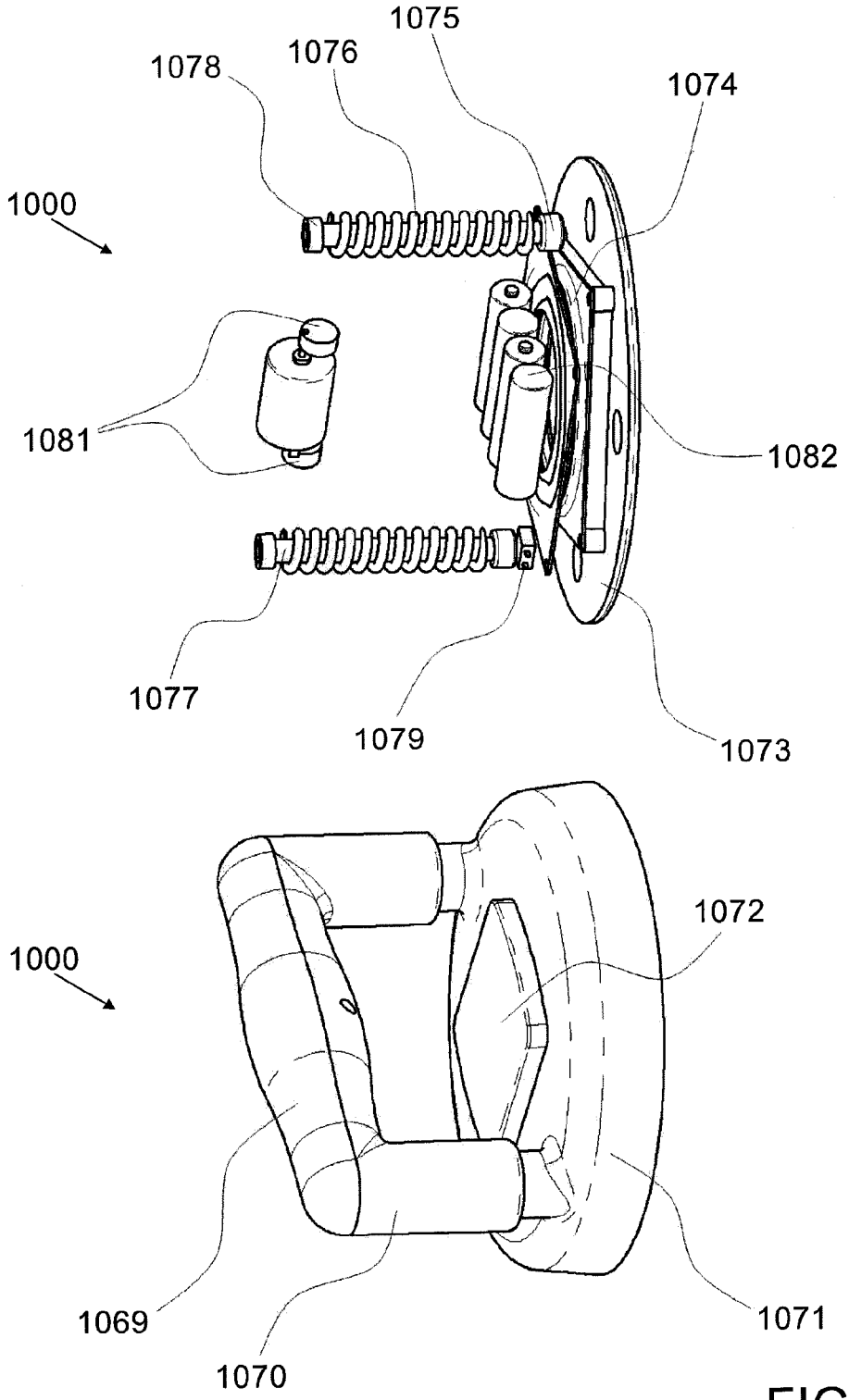
FIG. 10 is a schematic illustration of an alternative aerobic exercise device including a push-up grip handle with a vibration system, according to an exemplary embodiment of the invention.

FIG. 10 is a schematic illustration of an alternative aerobic exercise device 1000 including a push-up grip handle with a vibration system, according to an exemplary embodiment of the invention.

In an exemplary embodiment of the invention, aerobic exercise device 1000 includes the following elements:

1069—Upper part of the handle;
1070—Lower part of the handle;
1071—Push-up handle base;
1072—Control panel and power source cover;
1073—Stationary base of the push-up handle;
1074—Planar bearing;
1075—Positioning guide ring for shaft 1077;
1076—Spring;
1077—Shaft;
1078—Ring support;
1079—Switch/micro switch;
1080—Motor;
1081—Un-balanced weighs;
1082—Power source.

Adding vibration or stimulators like EMS to the push-up grip handles enhance the workout.

The vibrating handles 1069, 1070 are fitted on top of the push-up handle base 1071 and can slide on top of it. The vibrating handles 1069, 1070 are positioned on top of the ring 1078. The ring 1078 is anchored to the shaft 1077 delivering the pressure down from the handle 1069, 1070 against the springs 1076 through the rings 1075. The rings 1075 are connected to the base 1071 that is placed on the planer bearing 1074. During the push-ups, the handle 1069, 1070 is pushed down while pressing the switch 1079 located under the shaft 1077.

Once the workout is finished, the springs 1076 push up the shaft 1077 from the switch 1079 using the rings 1078 and stops the vibration.

The push up handle base 1071 placed on top of the planar bearing 1074 can rotate with the rest of the system while the stationary base of the push-up handle 1073 doesn't move.

The power source 108210 can activate the motor 1080 to rotate the un-balanced weights 1081 only when the switch 1079 is being pressed or when the user activates the system using the control panel 1072. The control panel 1072 can control the system vibration frequency, intensity and the like, recommend workouts and monitor activities.

Figure 11:
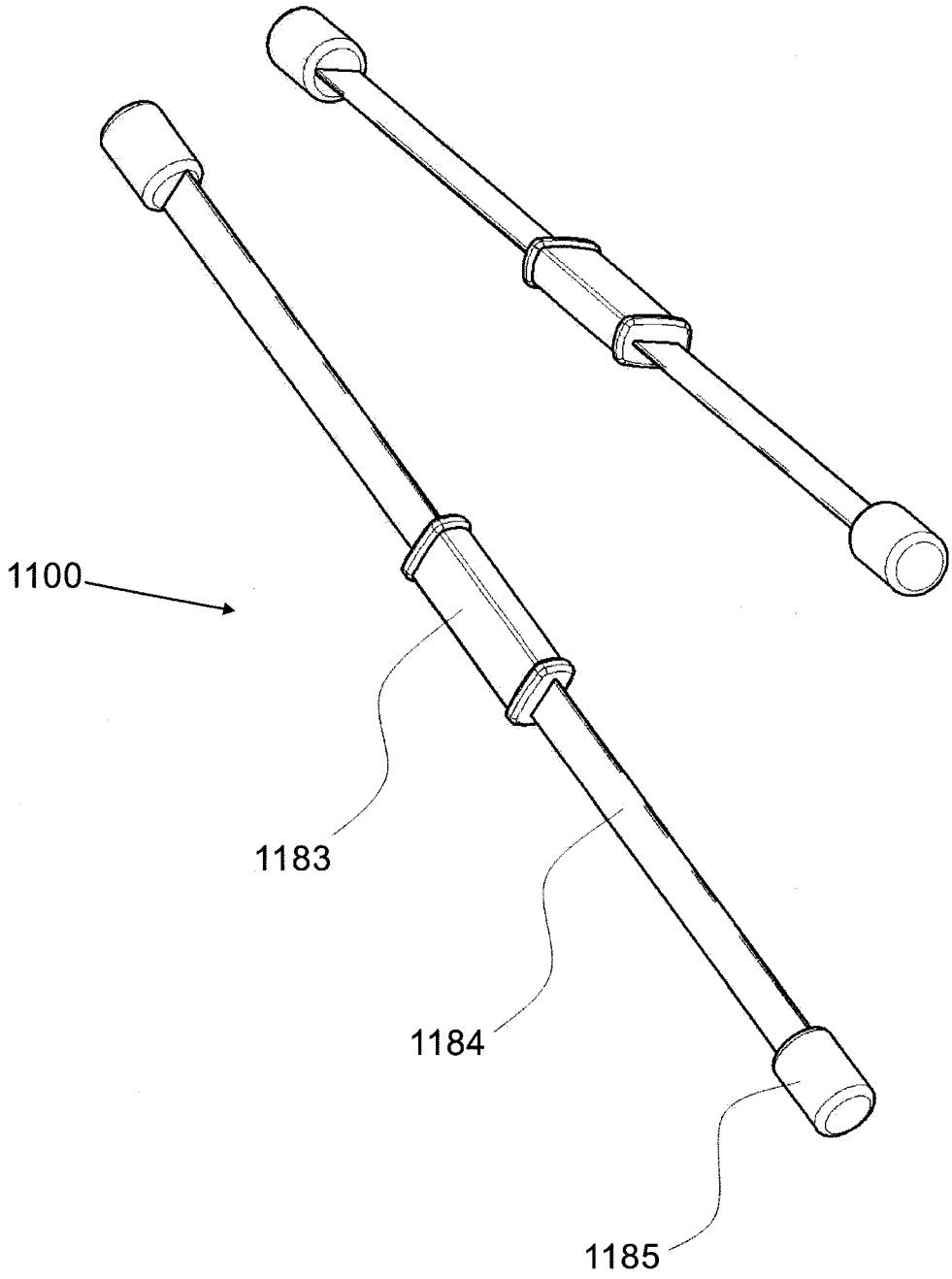
FIG. 11 is a schematic illustration of an alternative aerobic exercise device including a flexible rod with a vibration system, according to an exemplary embodiment of the invention.

FIG. 11 is a schematic illustration of an alternative aerobic exercise device 1100 including a flexible rod with a vibration system, according to an exemplary embodiment of the invention.

In an exemplary embodiment of the invention, aerobic exercise device 1100 includes the following elements:

1183—Vibrating handle;

1184—Flexible rods;

1185—Weights.

When the handle is shaking, the flexible rods 1184 attempt to follow the handle along with the weights while creating oscillations that the muscles resist. Adding vibration 1183 using the included vibration system inside the handle (not shown, inside 1183) the workout is more intense. In addition, electrical stimulators (EMS) can be included or replace the vibration system.

Optionally, handle 1183 can include heart monitors.

Figure 12:
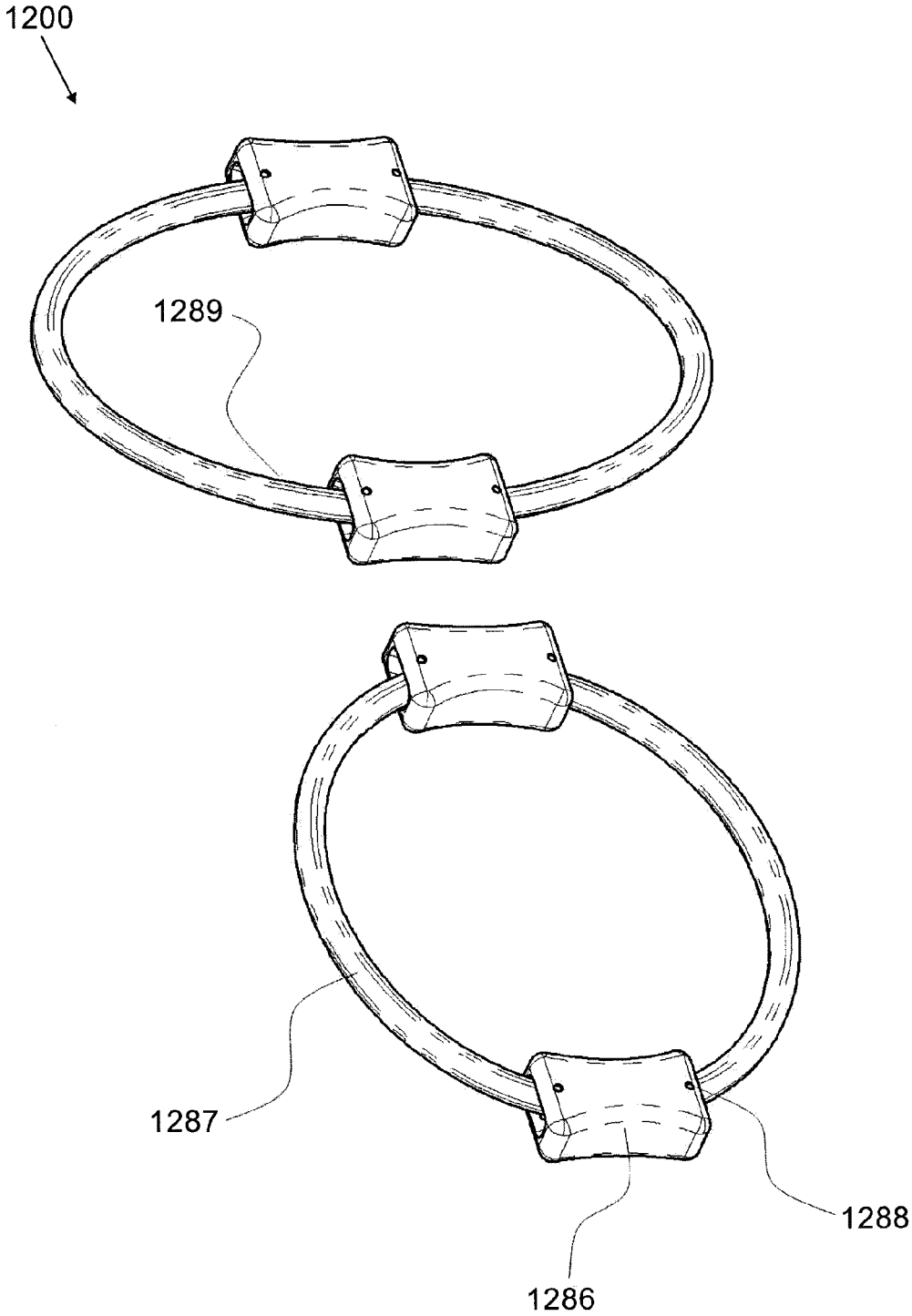
FIG. 12 is a schematic illustration of an alternative aerobic exercise device including a resistance ring with a vibration system, according to an exemplary embodiment of the invention.

FIG. 12 is a schematic illustration of an alternative aerobic exercise device 1200 including a resistance ring with a vibration system, according to an exemplary embodiment of the invention.

In an exemplary embodiment of the invention, aerobic exercise device 1200 includes the following elements:

1286—Vibrating handles equipped with stimulators;

1287—Flexible ring/circle;

1288—Connector between 86 and 87;

1289—The flexible ring being pressed.

In an exemplary embodiment of the invention, the flexible ring 1287 can be pressed 1289 and stretched during an upper and lower body exercise workout.

Optionally, adding vibrations by using vibrational grip handles 1286 can stimulate the user and enhance the workout. In some embodiments of the invention, the handles can include other stimulators (besides vibration) like electrical stimulators to enhance the muscles workout.

Figure 13:
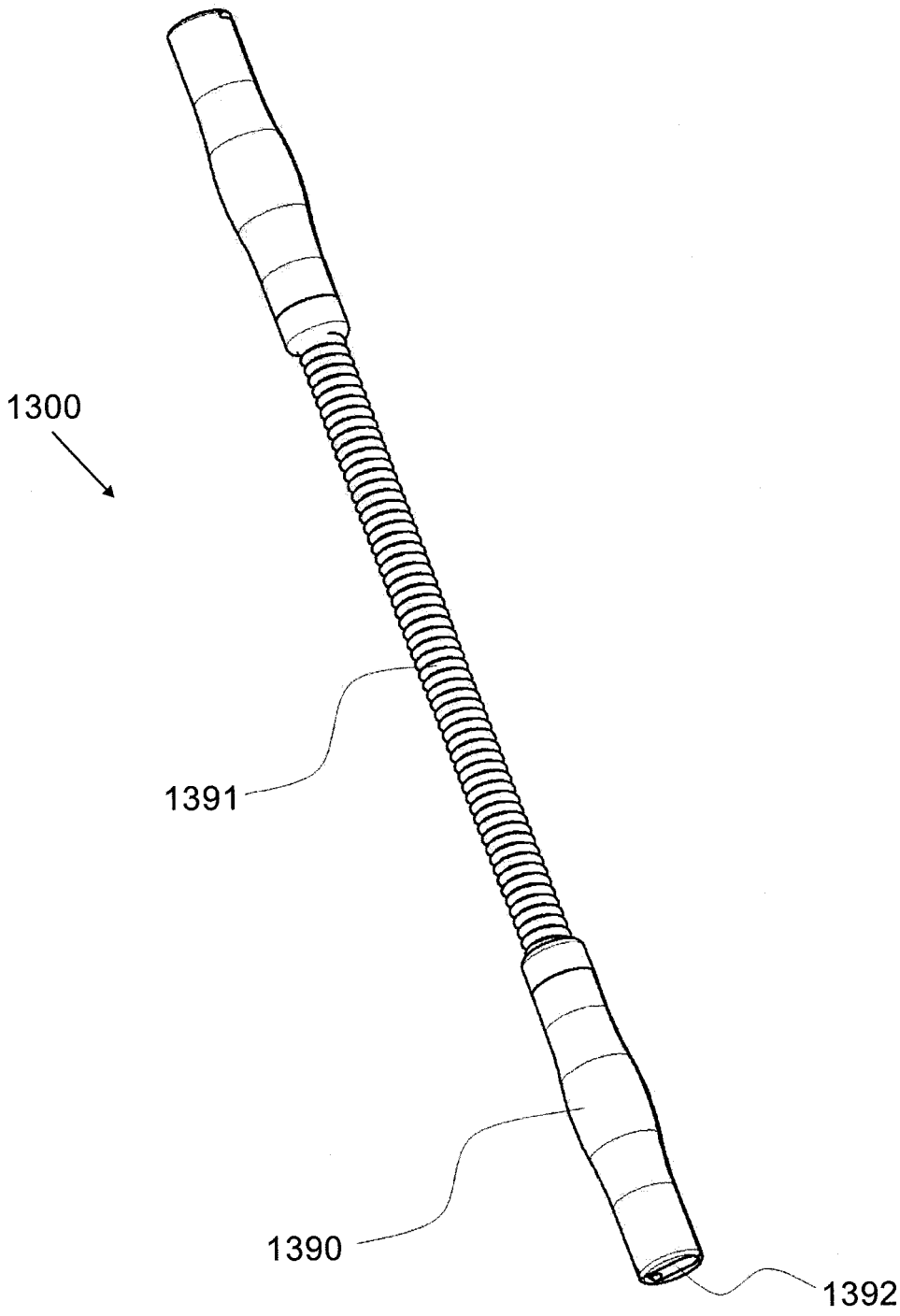
FIG. 13 is a schematic illustration of an alternative aerobic exercise device including a resistance spring power twister with a vibration system, according to an exemplary embodiment of the invention.

FIG. 13 is a schematic illustration of an alternative aerobic exercise device 1300 including a resistance spring power twister with a vibration system, according to an exemplary embodiment of the invention;

In an exemplary embodiment of the invention, aerobic exercise device 1300 includes the following elements:

1390—Vibrating handles;

1391—Resistance spring;

1392—Charging socket and power source replacement cap.

In an exemplary embodiment of the invention, the resistance spring 1391 is adapted to bend during various types of workouts.

Adding vibration or stimulators (like EMS) using the grip handles 1390 can stimulate the user and enhance the workout.

Figure 14:
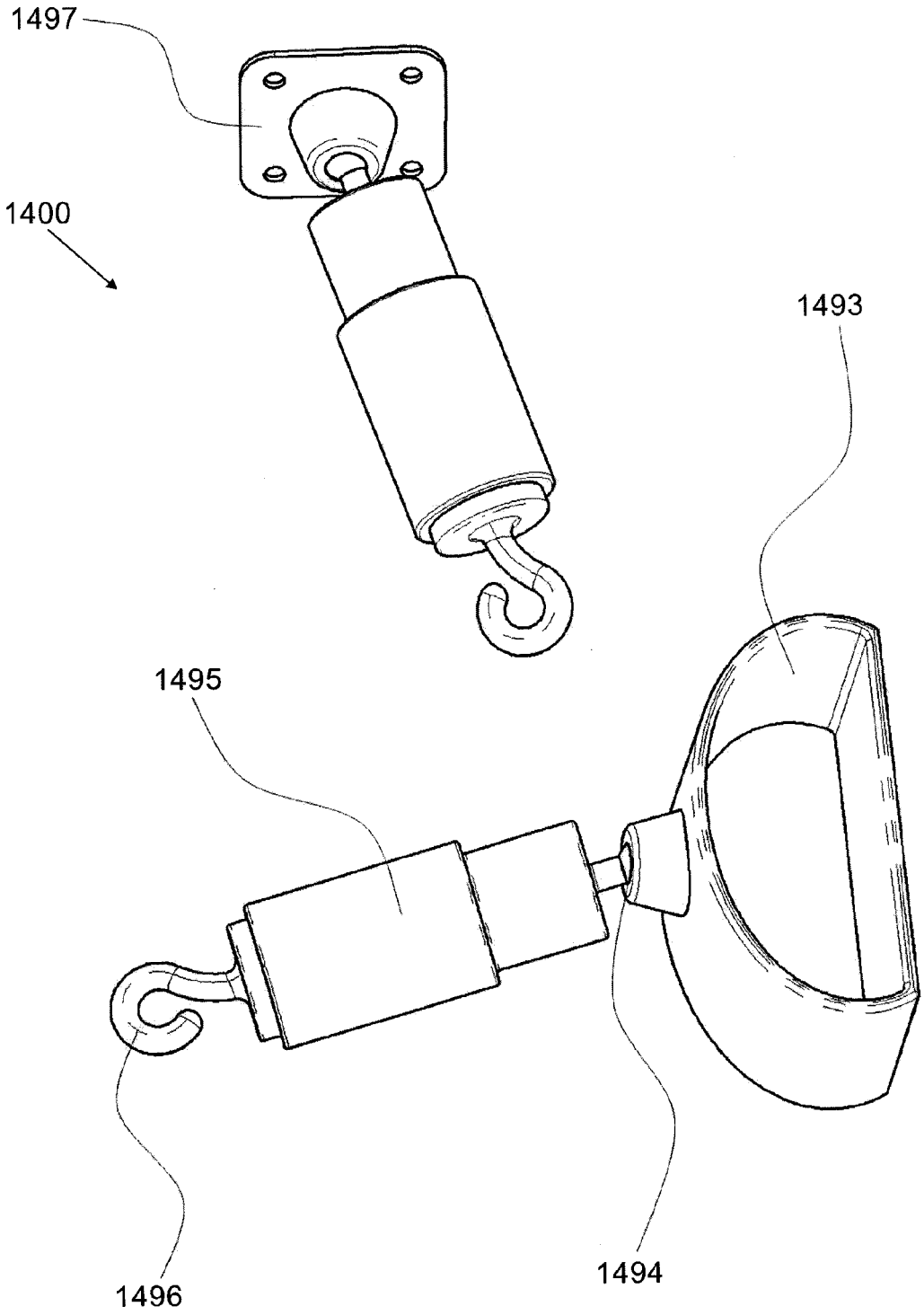
FIG. 14 is a schematic illustration of an alternative aerobic exercise device including a foot anchor and various attachments with a vibration system, according to an exemplary embodiment of the invention.

FIG. 14 is a schematic illustration of an alternative aerobic exercise device 1400 including a foot anchor and various attachments with a vibration system, according to an exemplary embodiment of the invention;

In an exemplary embodiment of the invention, aerobic exercise device 1400 includes the following elements:

1493—Foot anchors;

1494—Connector between 1493 and 1495;

1495—Vibration source;

1496—Anchor;

1497—Surrounding attachment.

In an exemplary embodiment of the invention, by connecting to the vibration source 1495 using the anchor 1496, every element can be vibrated, including but not limited to ropes, cables (flexible or rigid), springs, rods and the like.

The vibration source 1495 can include a motor rotating an un-balanced weight to create rotation vibration, solenoids to create linear vibration and the like.

The vibration system can be mounted using the foot, with the foot anchor 1493 or to the surroundings, including floors, wall, ceilings and the like using the surrounding attachment 1497.

The connector 1494 is a ball joint connector to allow multiple angles relative to the anchoring. The ball joint 1494 can be replaced with other types of connector, including flexible materials like rubber, cables and the like.

Figure 15:
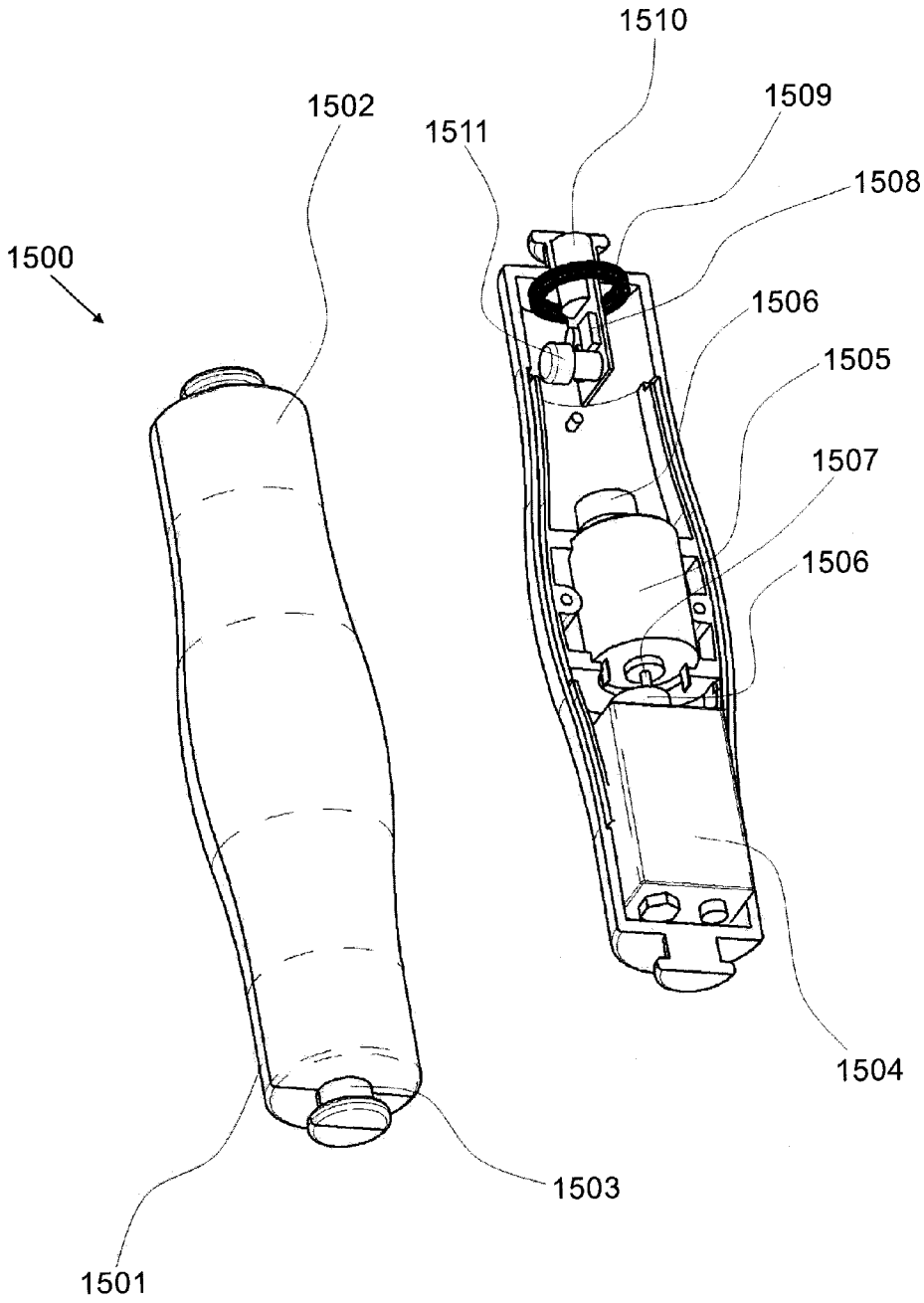
FIG. 15 is a schematic illustration of a vibrational member for use as a grip handle with an aquatic exercise device, according to an exemplary embodiment off the invention.

FIG. 15 is a schematic illustration of a vibrational member 1500 for use as a grip handle with an aquatic exercise device, according to an exemplary embodiment off the invention.

In an exemplary embodiment of the invention, vibrational member 1500 includes the following elements:

1501—The upper part of the casing of the handle;

1502—The lower part of the casing of the handle;

1503—Connecting interface between the handle and optional attachments;

1504—Power source

1505—Motor

1506—Unbalanced weight

1507—Shaft connecting between the motor 1505 and the unbalanced weight 1506;

1508—Control circuit

1509—inductive charging coil

1510—strain gauge

1511—accelerometer

The handle casing 1501+1502 contains the basic elements of the vibration system. Using the connectors 1503 that are located on each side of the handle, the handle can be fitted with optional attachments to form aquatic exercise devices.

The power source 1504, located inside the handle 1501+1502, supply the motor 1505 with the required energy to rotate the weights 1506. The motor shaft 1507 connects between the motor 1505 and the ex-center of the weights 1506 creating an unbalanced rotation method resulting in vibration.

This optional embodiment of the vibrating system can be replaced with other vibrational systems known in the arts, for example solenoids, crank shafts, piezoelectric elements and the like.

The control circuit 1508 activates controls and measures the system. The control circuit 1508 can turn on and off the vibration, set the vibration frequency, measure pre-determined parameters (such as usage counters, distance, calories) and other required tasks.

The control circuitry can also collect and store the information to be analyzed afterwards with dedicated software.

The activation of vibrational member 1500 can be done by using control buttons (not shown), a strain gauge 1510 that detects the resistance of the water on the attachments, accelerometer 1511 that detects the movements of the attachments and using other sensors.

The power source 1504 can be charged using various methods such as connecting to an electrical outlet (not shown), a power induction coil 1509, or harvesting the movement energy formed during use of vibrational member 1500.

Optionally, the handle may include various buttons to control the system, a screen to display and select information, an interface to connect the system to a PC, a pulse detector, a cadence detector, a workout and training planner, an EKG meter, or other features.

Figure 16:
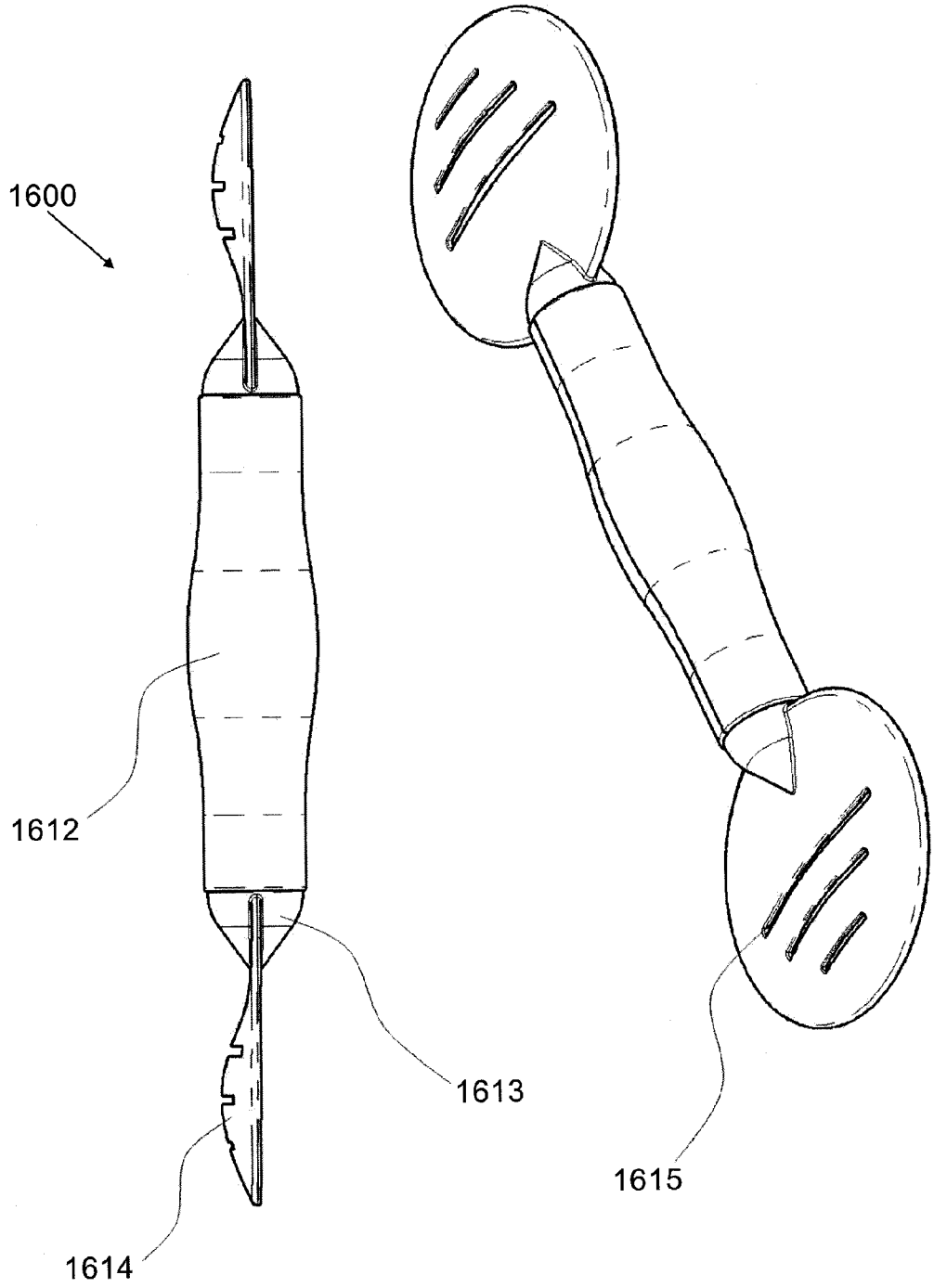
FIG. 16 is a schematic illustration of an aquatic exercise device including a vibrating grip handle and water paddles, according to an exemplary embodiment off the invention.

FIG. 16 is a schematic illustration of an aquatic exercise device 1600 including a vibrating grip handle and water paddles, according to an exemplary embodiment off the invention.

In an exemplary embodiment of the invention, aquatic exercise device 1600 includes the following elements:

1612—A handle (e.g. vibrational member 1500) as described regarding FIG. 15;

1613—Connection interface fitting 1514 together with 1512;

1614—Concaved paddle for shoveling liquids;

1615—Water channeling grooves.

In an exemplary embodiment of the invention, handle 1512 is fitted with two paddles 1514 located on each side of the handle 1512 using the connection interface 1513.

During activity, grooves 1515 allow the water to channel through the paddle smoothing the movement while providing flexibility to the paddle structure.

Adding the vibration to aquatic exercise device 1600 will enhance and improve the body workout and bone strength.

Figure 17:
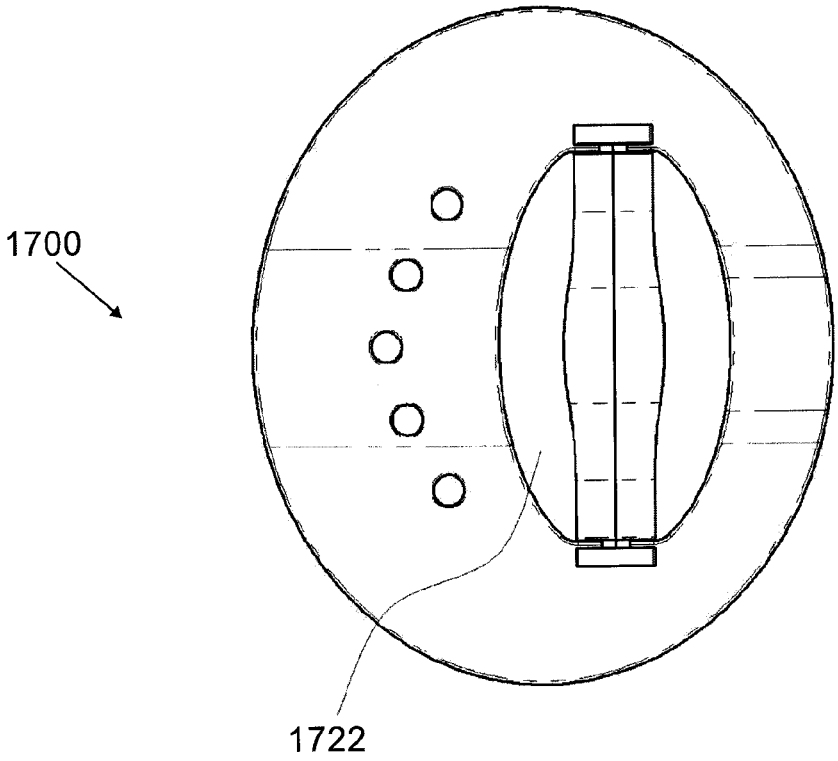
FIG. 17 is a schematic illustration of an aquatic exercise device including a vibrating grip handle and a swim paddle, according to an exemplary embodiment off the invention.
Figure 17:
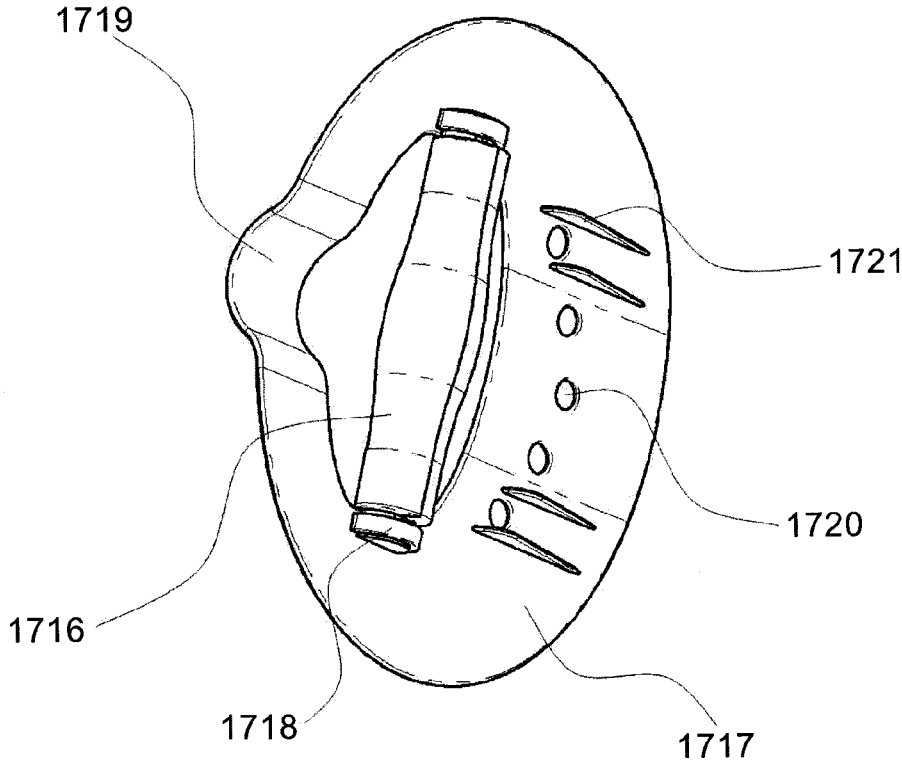

FIG. 17 is a schematic illustration of an aquatic exercise device 1700 including a vibrating grip handle and a swim paddle, according to an exemplary embodiment off the invention;

In an exemplary embodiment of the invention, aquatic exercise device 1700 includes the following elements:

1716—A handle (e.g. vibrational member 1500) as described regarding FIG. 15;

1717—A paddle structure attachment;

1718—A Connection interface fitting 1716 together with attachment 1717;

1719—Wrist support placer;

1720—Water channeling holes;

1721—Fins;

1722—The palm area.

In an exemplary embodiment of the invention, handle 1716 is fitted inside a swim paddle 1717. The contoured swim paddle allows the user's palm to grip the handle 1716 through opening 1722 while the wrist is positioned inside 1719.

Optionally, holes 1720 allow water to channel through paddle 1717, and thus increasing fluidity of the stroke and feel for the water while fins 1721 steer the fluidity.

Figure 18:
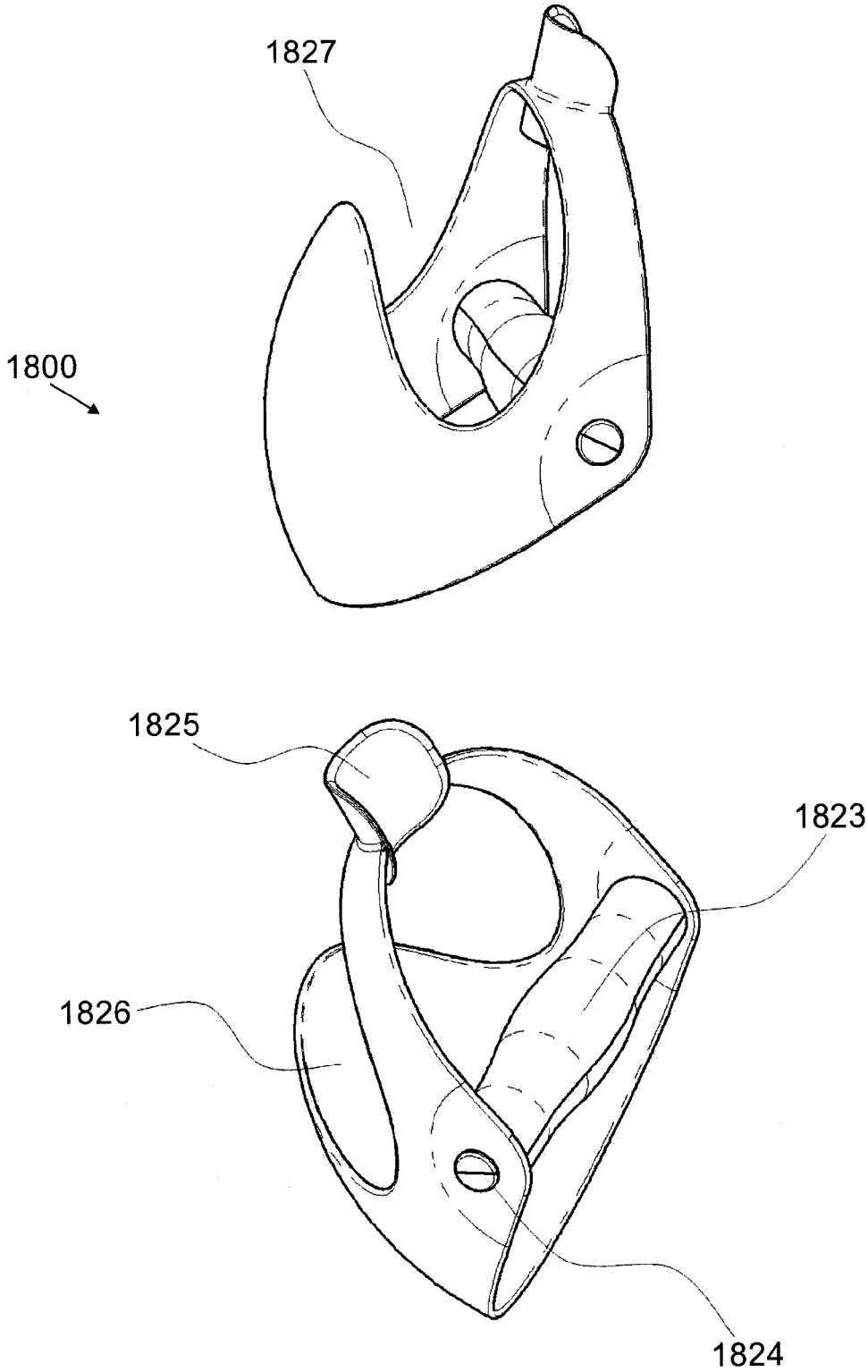
FIG. 18 is a schematic illustration of an aquatic exercise device including a vibrating grip handle and an alternative swim paddle, according to an exemplary embodiment off the invention.

FIG. 18 is a schematic illustration of an aquatic exercise device 1800 including a vibrating grip handle and an alternative swim paddle, according to an exemplary embodiment off the invention.

In an exemplary embodiment of the invention, aquatic exercise device 1800 includes the following elements:

1823—A handle (e.g. vibrational member 1500) as described regarding FIG. 15;

1824—Connection interface fitting handle 1823 together with the paddle structure 1826;

1825—Wrist support placer;

1826—The palm area and the paddle structure;

1827—Water channeling opening.

In an exemplary embodiment of the invention, handle 1523 is fitted inside the palm area 1826. The contoured swim paddle allows the palm to grip handle 1823 while the wrist is supported inside by wrist support placer 1825.

Optionally, the water channeling opening 1827 allows water to channel through the paddle, increasing the fluidity of the user's stroke.

Figure 19:
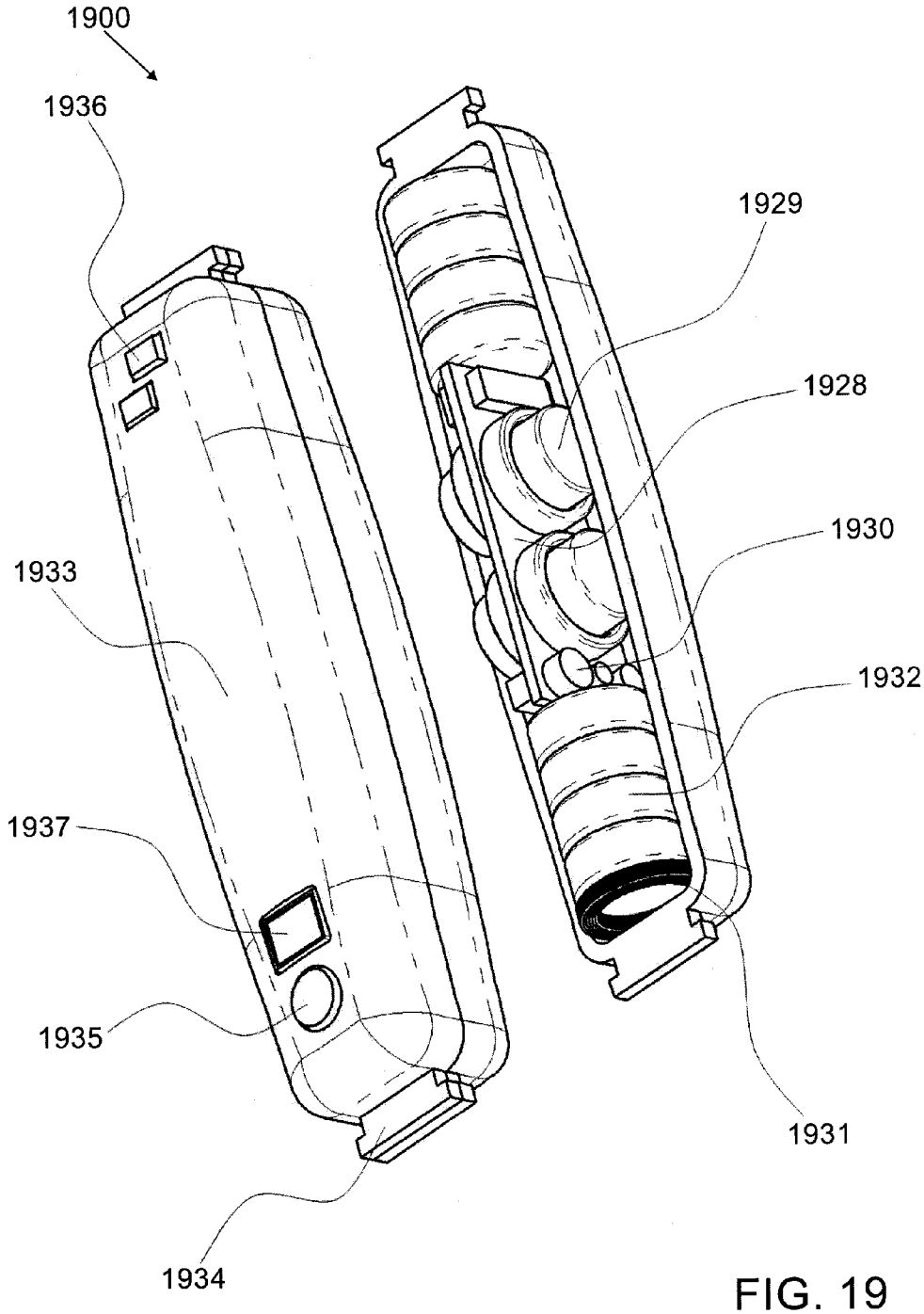
FIG. 19 is a schematic illustration of an alternative vibrational member for use as a grip handle with an aquatic exercise device, according to an exemplary embodiment off the invention.

FIG. 19 is a schematic illustration of an alternative vibrational member 1900 for use as a grip handle with an aquatic exercise device, according to an exemplary embodiment off the invention.

In an exemplary embodiment of the invention, vibrational member 1900 includes the following elements:

1928—Base board;

1929—Solenoids vibration weights;

1930—Control circuit;

1931—Inductive charging coil;

1932—Power source;

1933—Handle casing;

1934—Connecting interface of the handle to the gear to be used;

1935—Control buttons;

1936—Alternate control buttons;

1937—Screen.

In an exemplary embodiment of the invention, handle casing (33) contains the basic elements of the vibration system. Using the connectors (34) that are located on each side of the handle, the handle can be fitted with the appropriate attachments.

The power source 1932, located inside the handle casing 1933, supplies the solenoids 1929 with the required energy to vibrate weights. The solenoids vibration weights 1929 and the control circuit 1930 are mounted on the base board 1928 inside the handle casing 1933.

Optionally, the power source 1932 may be charged using the power induction coil 1931.

In an exemplary embodiment of the invention, the control buttons 1935, and 1936 together with the screen 1937 control the control circuit 1930. Optionally, by pressing the control buttons 1935, 1936 the control circuit 1930 is instructed to change the vibration frequency, vibration intensity, workout plans, collect and store the workout data, and the like.

Figure 20:
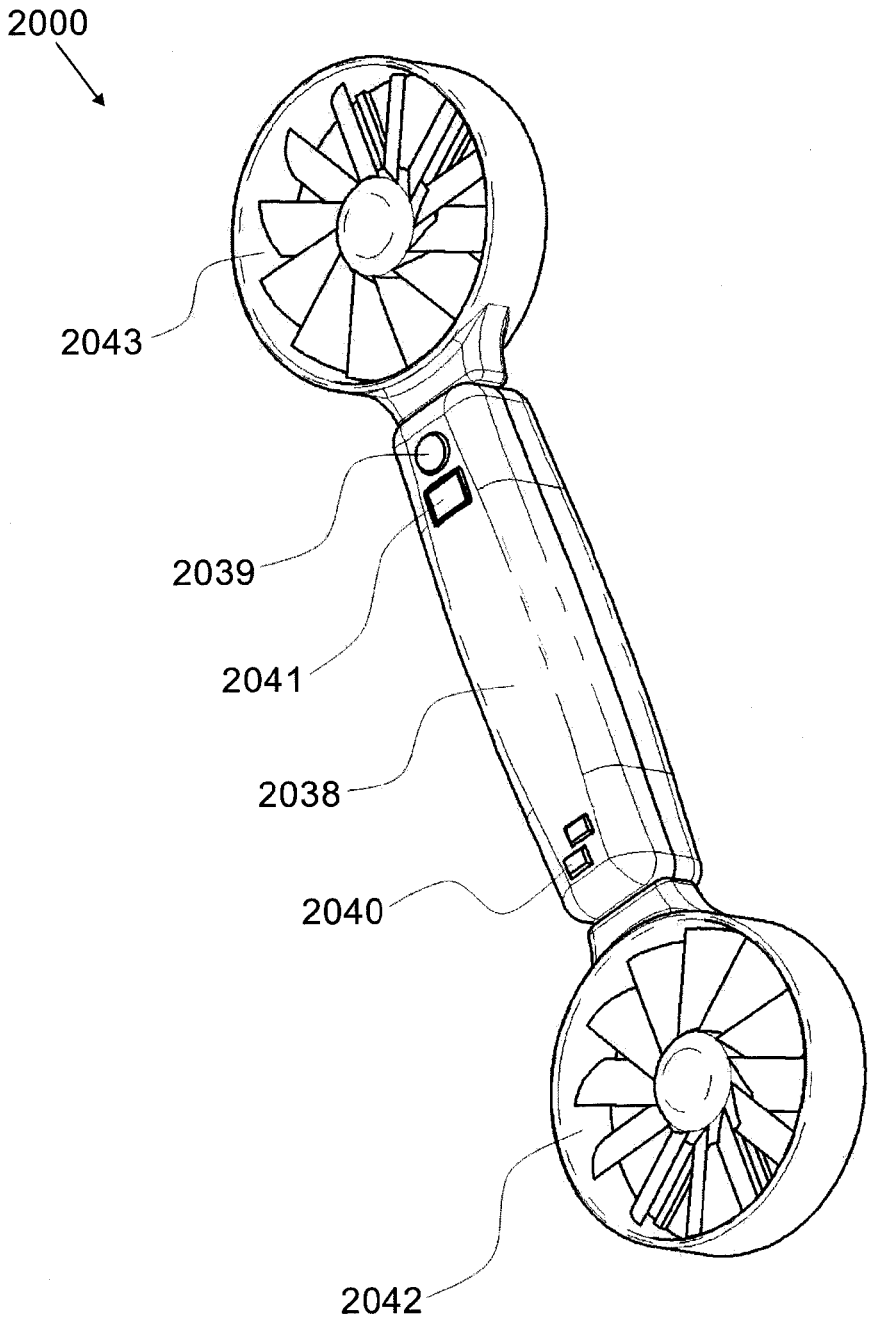
FIG. 20 is a schematic illustration of an aquatic exercise device including a vibrating grip handle and a water turbine paddle, according to an exemplary embodiment off the invention.

FIG. 20 is a schematic illustration of an aquatic exercise device 2000 including a vibrating grip handle 1900 and a water turbine paddle, according to an exemplary embodiment off the invention;

In an exemplary embodiment of the invention, aquatic exercise device 2000 includes the following elements:

2038—A handle (e.g. vibrational member 1500 or 1900);

2039—Control button;

2040—Alternate Control buttons;

2041—Screen;

2042—A first turbine;

2043—A second turbine.

In an exemplary embodiment of the invention, handle 2038 is attached to a first turbine 2042 and a second turbine 2043 to perform water exercise. Optionally, turbines 2042 and 2043 are used to create modifiable resistance while exercising in the water. The resistance of the turbines rotation can be modified and controlled by changing the angle of the fins of the turbines (to manipulate the fluidity of water through the turbines fins) or by controlling the friction of rotation of the turbines. In an exemplary embodiment of the invention, the fins of turbine 2042 are positioned inversely to the fins of turbine 2043 to prevent yawing. Optionally, turbines 2042, 2043 can also take advantage of the energy created by their rotation to charge the handle power source (e.g. 1932) and to collect information regarding the workout (duration, power, intensity, and the like).

In an exemplary embodiment of the invention, control buttons 2039, and 2040 together with the screen 2041 control the system vibration frequency and strength, workout plans, collect and store the workout data, and the like.

Figure 21:
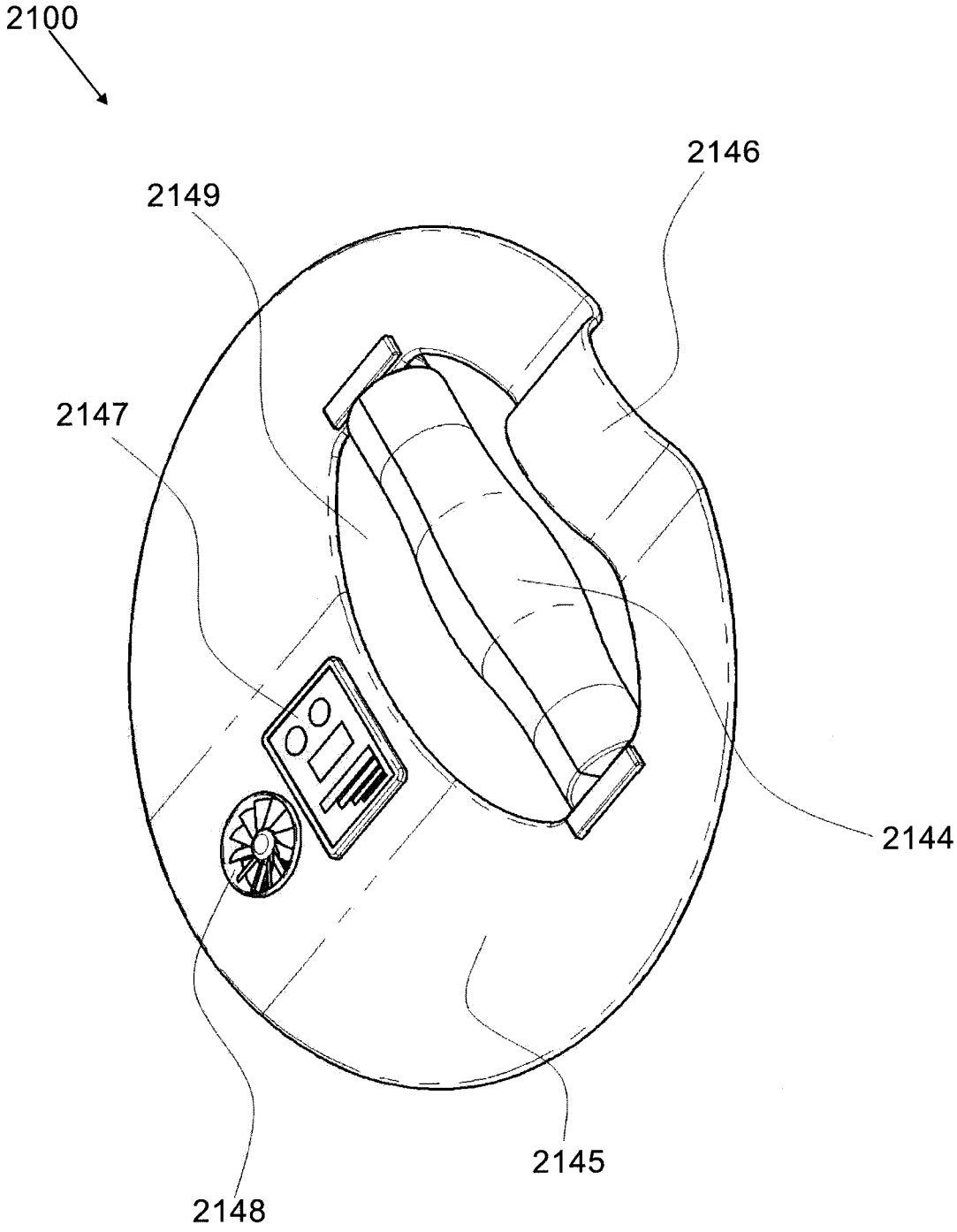
FIG. 21 is a schematic illustration of an aquatic exercise device including a vibrating grip handle and an alternative swim paddle, according to an exemplary embodiment off the invention.

FIG. 21 is a schematic illustration of an aquatic exercise device 2100 including a vibrating grip handle 1500 and an alternative swim paddle 2145, according to an exemplary embodiment off the invention.

In an exemplary embodiment of the invention, aquatic exercise device 2100 includes the following elements:

2144—A handle (e.g. vibrational member 1500 or 1900);

2145—The paddle structure;

2146—Wrist support placer;

2147—Control panel;

2148—Turbine;

2149—The palm area.

In an exemplary embodiment of the invention, handle 2144 is fitted inside a swim paddle structure 2145. The contoured swim paddle allows the palm to grip handle 2144 through the opening 2149 while the wrist is positioned inside 2146.

Optionally, turbine 2148 allows water to channel through the paddle, and is used to measure and monitor the workout.

The control panel 2147 includes buttons and a screen to control and monitor the system settings.

Figure 22:
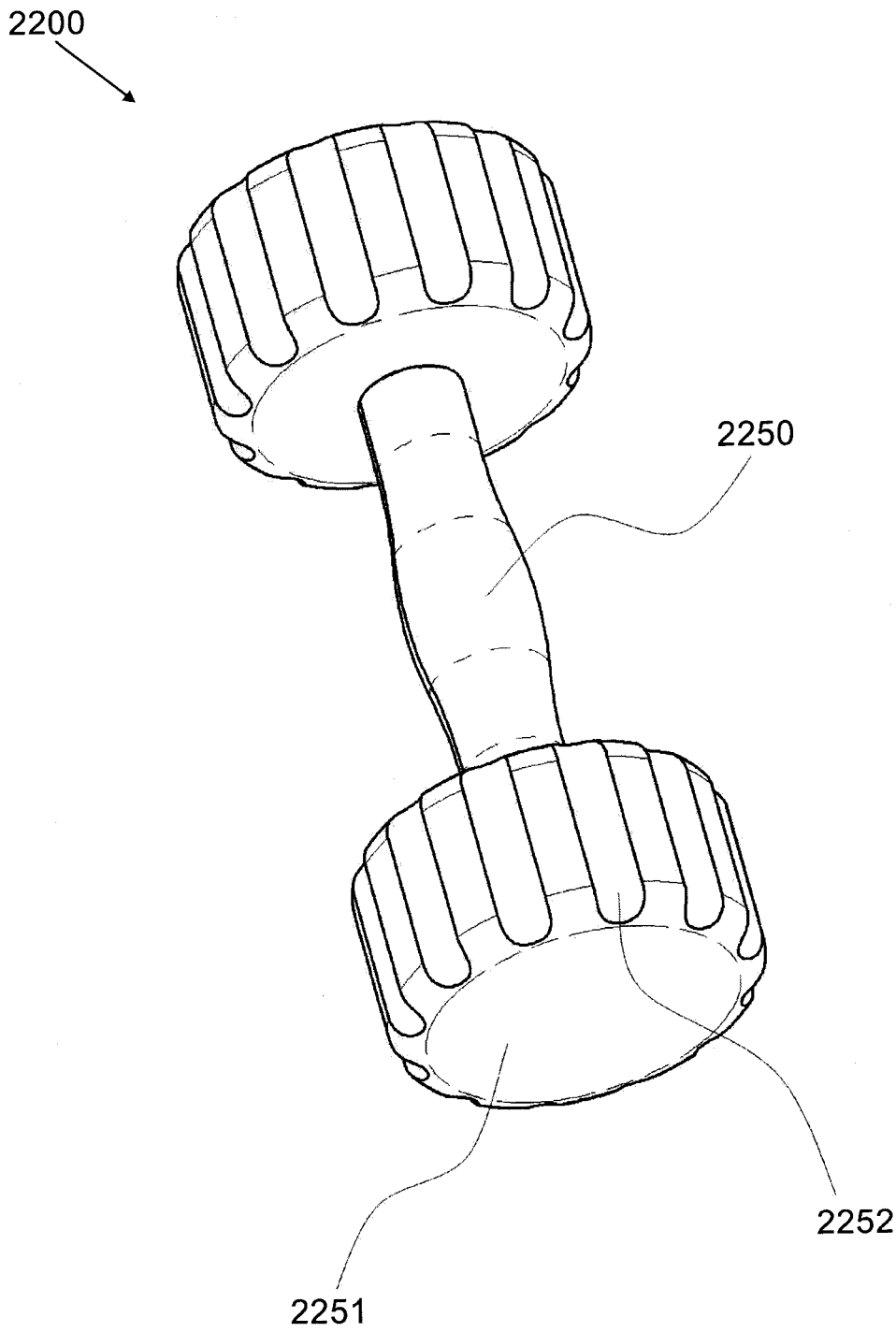
FIG. 22 is a schematic illustration of an aquatic exercise device including a vibrating grip handle in a hand buoy, according to an exemplary embodiment off the invention.

FIG. 22 is a schematic illustration of an aquatic exercise device 2200 including a vibrating grip handle 1500 in a hand buoy, according to an exemplary embodiment off the invention.

In an exemplary embodiment of the invention, aquatic exercise device 2200 includes the following elements:

2150—A handle (e.g. vibrational member 1500 or 1900);

2151—Buoys;

2152—Grooves.

In an exemplary embodiment of the invention, handle 2250 is fitted inside a hand buoys. The hand buoys are used on top of the water for buoyant support and stabilization and used underwater for resistance. The added vibration amplifies this training aid for water aerobics, arthritis classes or aquatic fitness activities achievements.

The grooves 2252 are used to create drifts and increase friction during the movement through the water.

Optionally, the buoys 2251 may include weights to adjust their floating ability.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the invention. Further combinations of the above features are also considered to be within the scope of some embodiments of the invention.

It will be appreciated by persons skilled in the art that the present invention is not limited to what has been particularly shown and described hereinabove. Rather the scope of the present invention is defined only by the claims, which follow.

We claim:

1. An exercise device, comprising:

at least one vibrational member serving as a vibration source;

a contact element for grasping the exercise device by a trainee while performing exercise with the exercise device;

a power interface adapted to enable powering the vibrational member;

one or more attachments connected to the vibrational member, wherein said attachments include an elastic member or biasing member forming an aerobic exercise device that is adapted to resist the trainee's motion during an aerobic workout;

or wherein said attachments include an aquatic member that is designed to provide buoyancy or resist motion through water forming an aquatic exercise device;

or wherein said attachments are weights forming a barbell and the weights are made up from a plurality of small unit masses, each unit mass cushioned by a cushioning material; and wherein the contact element is vibrated by the at least one vibrational member to deliver vibrational energy into muscles of the trainee while reducing absorption of vibrational energy by the attachments.

2. An exercise device according to claim 1, wherein said vibrational member is shaped as an elongated bar.

3. An exercise device according to claim 1, wherein said attachments are positioned off center at their connection points to the vibrational member.

4. An exercise device according to claim 3, wherein the attachment on one side is positioned off center in the opposite direction as the attachment on the other side of the vibrational member.

5. An exercise device according to claim 1, wherein said power interface is located in the vibrational member.

6. An exercise device according to claim 1, wherein said power interface is located in one of the attachments connected to the vibrational member.

7. An exercise device according to claim 6, wherein the total weight of the attachment with the power interface is substantially the same as the weight of the other attachments.

8. An exercise device according to claim 1, wherein said attachments are identical.

9. An exercise device according to claim 1, wherein said attachments differ in properties selected from the group consisting of weight, size, form, buoyancy, elasticity, and conductivity.

10. An exercise device according to claim 1, wherein said vibrational member includes an activation switch that is activated by exercising with the exercise device.

11. An exercise device according to claim 1, wherein the properties of the vibrations are user controllable.

12. An exercise device according to claim 11, wherein the controllable properties of the vibrations are selected from the group consisting of frequency, intensity, amplitude, duration, direction and pattern.

13. An exercise device according to claim 1, wherein the force required to be applied by the user to use the exercise device is user controllable.

14. An exercise device according to claim 1, wherein said vibrational member is detachable.

15. An exercise device according to claim 1, wherein said attachments are detachable.

16. An exercise device according to claim 1, wherein said vibrational member is encapsulated in a water proof encapsulation.

17. An exercise device according to claim 1, wherein the plurality of small unit masses are wrapped together in a single plane.

18. An exercise device according to claim 1, wherein the attachments include anchors to anchor the exercise device to non movable objects during use of the exercise device.

19. An exercise device according to claim 1, wherein the vibrational member further comprises an electrical muscle stimulator.

20. An exercise device according to claim 19, wherein the electrical muscle stimulator is activated simultaneously with the vibrations by the vibrational member.

21. An exercise device according to claim 1, comprising a power source that is charged by performing exercise with the exercise device.

22. An exercise device according to claim 1, wherein the vibrational member further comprises sensors to monitor the exercise device.

23. An exercise device according to claim 1, wherein the vibrational member further comprises one or more elements selected from the group consisting of: a CPU, a display, a memory, control buttons, an input circuit, an output circuit and a control circuit.

24. An exercise device according to claim 1, wherein the device includes vibration dampers between the vibrational member or contact element and the rest of the device or its surrounding; and wherein the vibration dampers are designed to substantially isolate the exercise device from the vibrations generated by the vibration source and substantially transmit the vibrations generated by the vibration source into the contact element and the muscles of the user.

25. An exercise device, comprising:

at least one vibrational member serving as a vibration source;

a contact element with an extension for coupling with the trainee while performing exercise with the exercise device;

a power interface adapted to enable powering the vibrational member;

one or more attachments connected to the vibrational member, wherein said attachments include an elastic member or biasing member forming an aerobic exercise device that is adapted to resist the trainee's motion during an aerobic workout;

or wherein said attachments include an aquatic member that is designed to provide buoyancy or resist motion through water forming an aquatic exercise device;

or wherein said attachments are weights forming a barbell and the weights are made up from a plurality of small unit masses, each unit mass cushioned by a cushioning material; and wherein the contact element is vibrated by the at least one vibrational member to deliver vibrational energy into muscles of the trainee while reducing absorption of vibrational energy by the attachments.

* * * * *